US005979659A

United States Patent [19]

Kataoka

[11] Patent Number: 5,979,659

[45] Date of Patent: Nov. 9, 1999

[54] SHEETS OF CORRUGATED PAPER FOR PRODUCING PACKINGS

[75] Inventor: Hachiro Kataoka, Nagoya, Japan

[73] Assignee: Chuo Pack Industry Co., Ltd., Aichi, Japan

[21] Appl. No.: 08/887,051

[22] Filed: Jul. 2, 1997

[30] Foreign Application Priority Data

Jul. 2, 1996 [JP] Japan ..... 8-172194

[51] Int. Cl.[6] ..... B65D 81/02; B65D 85/30

[52] U.S. Cl. ..... 206/588; 206/320; 206/591

[58] Field of Search ..... 206/320, 521, 206/583, 586–588, 591, 594

[56] References Cited

U.S. PATENT DOCUMENTS

| | | | |
|---|---|---|---|
| 2,160,816 | 6/1939 | Barnes | 206/586 |
| 5,341,934 | 8/1994 | Hsu | 206/591 |
| 5,398,808 | 3/1995 | Chen et al. | 206/320 |

FOREIGN PATENT DOCUMENTS

| | | | |
|---|---|---|---|
| 405004662 | 1/1993 | Japan | 206/588 |
| 8-39376 | 2/1996 | Japan . | |

*Primary Examiner*—Bryon P. Gehman
*Attorney, Agent, or Firm*—Lowe Hauptman Gopstein Gilman & Berner

[57] ABSTRACT

A set of flat sheets of corrugated paper 101A, 102A, 101B, and 102B are provided. The flat sheets 101A and 102A can be folded into first and second packing elements 201A and 202A, respectively, and these packing elements 201A and 202A in turn can be assembled into a first packing 300A. The flat sheets 101B and 102B can be folded into third and fourth packing elements 201B and 202B, respectively, and these packing elements 201B and 202B in turn can be assembled into a second packing 300B. Then, the two packings 300A and 300B can be used, instead of conventional packings of Styrofoam, to hold opposed end portions or opposed side portions of a product 400 of a rectangular or similar shape that have different shapes. According to another aspect of the invention, other sheets 101C and 102C of corrugated paper can be prepared to produce other packing elements 201C and 202C, which in turn can be assembled into another packing 300C for holding one end portion or one side portion of a product of such a shape. Two packings 300C, 300C can be employed to hold opposed end portions or opposed side portions of such a product, provided that those opposed end portions or opposed side portions have identical shapes. According to still another aspect of the invention, a packing 300D particularly useful for holding the top or bottom of a product with the shape of a cube, such as a microwave oven, can be assembled by using other packing elements 201D and 202D.

3 Claims, 14 Drawing Sheets

SHEETS OF CORRUGATED PAPER FOR PRODUCING PACKINGS

FIELD OF THE INVENTION

This invention relates to sheets of corrugated paper for producing packings especially useful for holding a product of a rectangular or similar shape that is particular sensitive to shock, such as a video recorder, personal computer, home-fax or other similar consumer electronics.

BACKGROUND OF THE INVENTION

A consumer electronic product is usually held with packings of Styrofoam in a cardboard box during its shipment from one place to another. Packings of corrugated paper are also often used for the same purpose. Styrofoam, however, is derived from petroleum, which is limited natural resources, and so we should avoid using that material as such a packing, which is destined for immediate disposal after it has served the function of protecting a product against damage and shock during transportation thereof from one place to another. Also, from the viewpoint of disposal, packings of Styrofoam are bulky garbage after use and, hence, their transport for disposal costs much. Also, such wastes are not suitable for land reclamation. Moreover if such wastes are burned, they generate intense heat and thus cause damage to the incinerator. The inventor hereof, therefore, has developed various packings of corrugated paper for use as an alternative to those of Styrofoam, and applied for patents for them.

SUMMARY OF THE INVENTION

Then, the object of the invention is to improve packings of corrugated paper that the inventor hereof sought to patent in Japanese Patent Application Serial No. 8-39376.

DETAILED DESCRIPTION OF PREFERRED EMBODIMENTS

Figure 1:
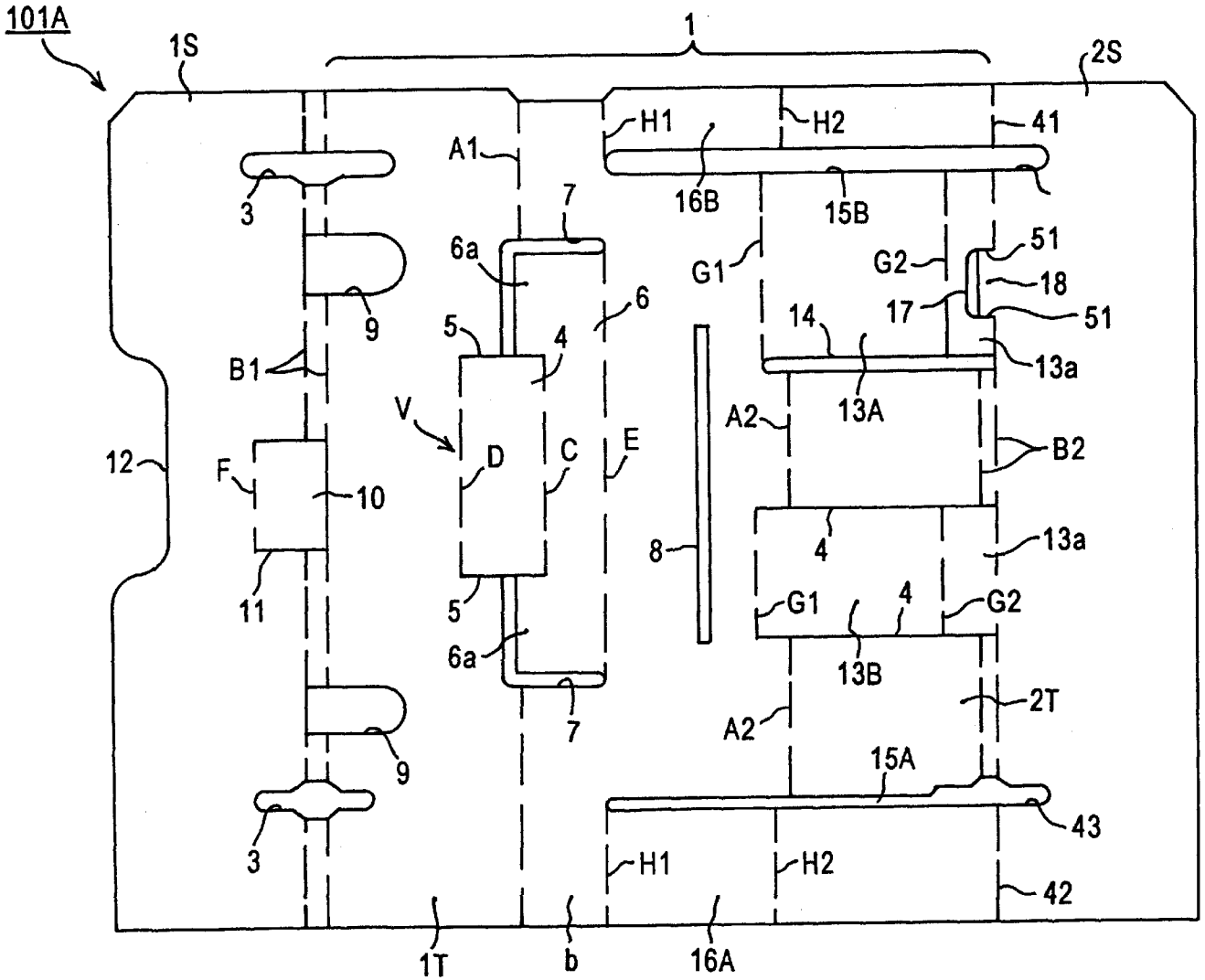
FIG. 1 is a plan view of a first flat sheet 101A of corrugated paper prepared according to the invention.

Different embodiments of the invention as illustrated in the drawings will now be described to give a more detailed account of the invention.

Figure 2:
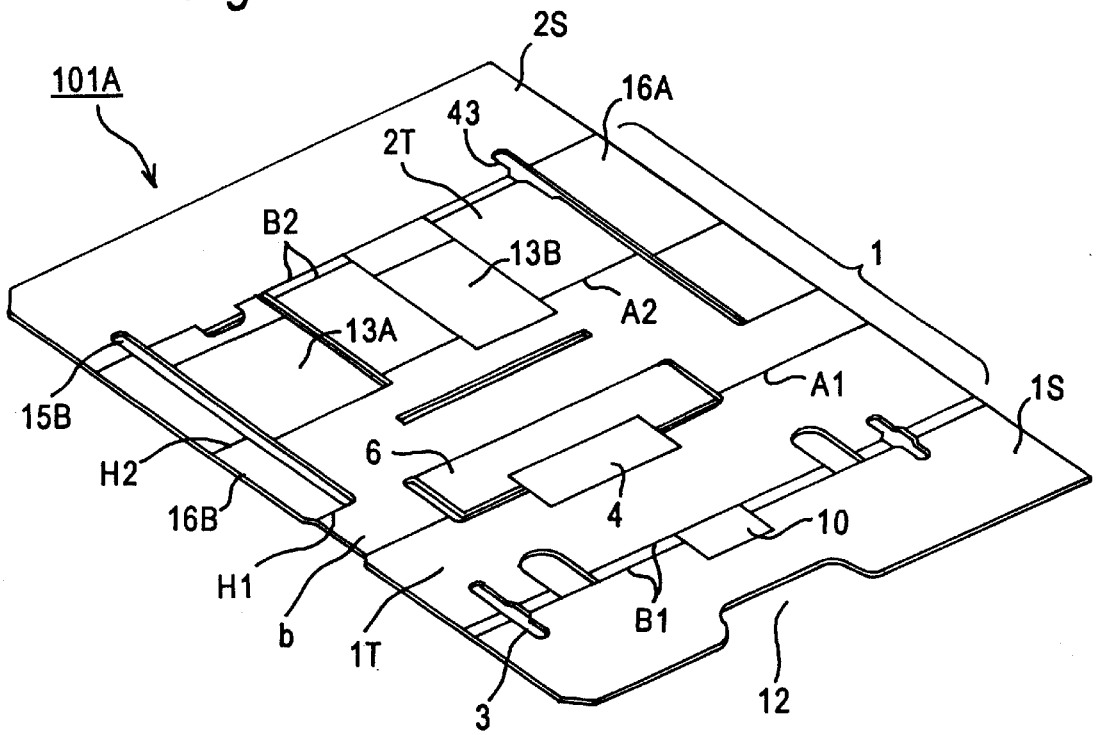
FIG. 2 is a perspective view of the first flat sheet 101A of FIG. 1.

FIG. 1 is a plan view of a first flat sheet 101A of corrugated paper prepared according to the invention. FIG. 2 is a perspective view of the same sheet 101A. This flat sheet 101A can be folded into a first packing element 201A of FIG. 3. A second packing element 202A of FIG. 5, which can be produced by folding a second flat sheet 102A of FIG. 4, can be mounted in the first packing element 201A of FIG. 3 to assemble a first packing 300A of FIG. 6.

As illustrated in FIG. 1, the flat sheet 101A comprises a central body section 1 and two outer side wall members 1S and 2S located with that section 1 between. This body section 1 has two parallel central creases, or major folding lines A1 and A2 that extend in the transverse direction of the sheet. The terms 'crease' and 'folding line' may be used interchangeably herein. The left-hand outer side wall member 1S is divided from the central body section 1 by transversely-extending double folding line B1. Similarly, the right-hand outer side wall member 2S is divided from the central body section 1 by a transversely-extending double folding line B2.

The body section 1 includes a bottom member b and two inner side wall members 1T and 2T located with the bottom member b therebetween. In the following, the terms 'bottom member' and 'bottom section' may be used interchangeably. Each inner side wall member is divided from the bottom member b by one major folding line A1 or A2. A transversely-extending slit 8 is formed in the bottom member b.

First, the left-hand side (in FIG. 1) of the bottom member b will be described in detail. The bottom member b embraces more than half of a support wall member 6 which is mostly defined by a transversely-extending folding line E and two L-shaped openings 7, 7. An inner side wall member 1T is divided from the bottom member b by the left-hand major folding line A1, and embraces a support surface member 4 along with the support wall member 6. The support surface member 4 is divided from the support wall member 6 by both a transversely-extending folding line C and two parallel longitudinally-extending narrow cuts 5, 5, and is similarly divided from the inner side wall member 1T both by a transversely-extending folding line D and by the two parallel cuts 5, 5. The support wall member 6 is divided from the inner side wall member 1T by the two L-shaped openings 7, 7. The support wall member 6 supports the support surface member 4 from below and retains the same member 4 in a horizontal position when the sheet 101A has been folded into a first packing element 201A of FIG. 3. Also, the support wall member has two projecting portions 6*a*, 6*a* with part of the support surface member 4 between. The support surface member 4 engages and supports a bottom member c of a second packing element 202A from below when a packing 300A of FIG. 6 has been assembled. An outer side wall member 1S is located adjacent to the inner side wall member 1T, and is for the most part divided from that member 1T by the parallel folding lines B1. This outer side wall member 1S has a recess 12. A longitudinally-extending slit 3 is formed near one side of the sheet 101A, and extends into both the outer and inner side wall members 1S and 1T. Another similar longitudinally-extending slit 3 is also provided near the opposed side of the sheet, and similarly extends into both the two side wall members 1S and 1T. Two relatively large openings 9, 9 each shaped like a round arch are provided inside the two slits 3, 3. The two openings 9, 9 start from the outer one of the two parallel folding lines B1, and extend into the inner side wall member 1T. A square supporting piece 10 is provided between the two side wall members 1S and 1T. To be more exact, this supporting piece 10 starts from the inner one of the double folding line B1, and is mostly embraced by the outer side wall member 1S . Three sides of the supporting piece 10 are defined by a narrow cut 11, and its remaining one side is defined by a transversely-extending folding line F.

Next, the right-hand side (in FIG. 1) of the bottom member b will be described. On the right-hand side of the bottom member is located an inner side wall member 2T corresponding to the left-hand inner side wall member 1T. This inner side wall member 2T is divided from the bottom member b by the folding line A2. The right-hand inner side wall member 2T, however, is separated into two halves by one cushion member 13B which is located between the bottom member b and a right-hand outer side wall member 2S. Another cushion member 13A is also located between the bottom member b and right-hand outer side wall member 2S, and is separated from the cushion member 13B by one half of the inner side wall member 2T. The right-hand outer side wall member 2S has a projecting portion 18 with opposed sides defined by short slits 51, 51. Each cushion member is divided from the bottom member b by one transversely-extending folding line G1. Also, each cushion member has another transversely-extending folding line G2 therein. The cushion member 13A is separated from one half (the upper half in FIG. 1) of the inner side wall member 2T by a longitudinally-extending slit 14. A transversely-extending short slit 17 is provided between the cushion member 13A and the projecting portion 18 of the outer side wall member 2S. Two opposed sides of the cushion member 13B are defined by two parallel longitudinally-extending cuts 44, 44, respectively. Reference numeral 13*a* designates a portion of each cushion member that is positioned in a horizontal plane when the sheet 101A has been folded into a first packing element 201A of FIG. 3. A wide end member 16A is provided between the bottom member b and outer side wall member 2S. Similarly a narrow end member 16B is located between the two members b and 2S on the opposed side of the wide end member 16A. Each end member 16A or 16B is divided from the bottom member b by both one transversely-extending folding line H1 and one long longitudinally-extending slit 15A or 15B. Another transversely-extending folding line H2 is also formed in each end member. Each long slit 15A or 15B defines one edge of the bottom member b. Also, the long slit 15A separates the wide end member 16A from the inner side wall member 2T, while the other long slit 15B separates the narrow end member 16B from the cushion member 13A. The long slit 15A has a larger portion 43. Each long slit extends into the outer side wall member 2S.

Figure 3:
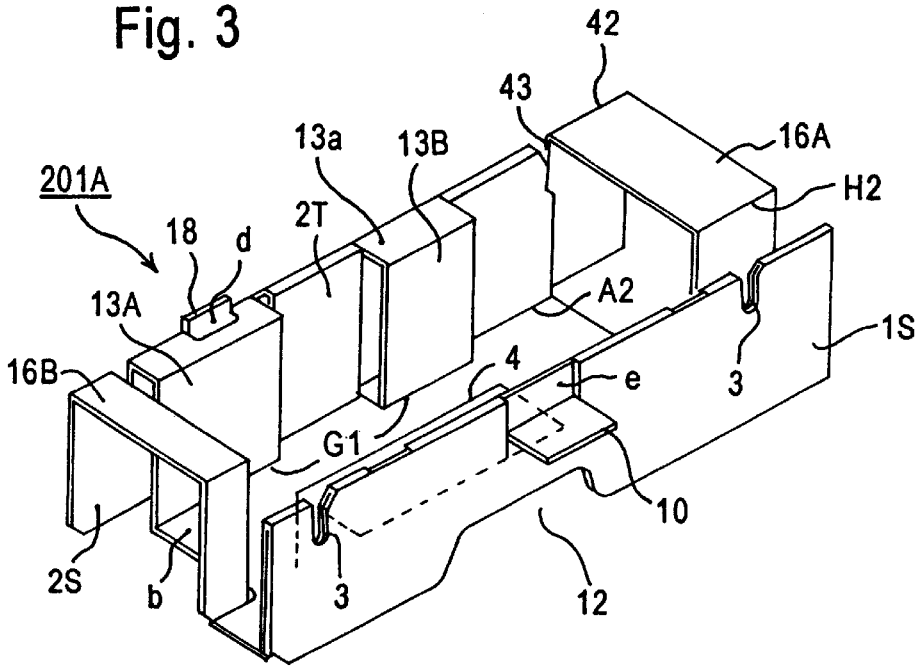
FIG. 3 shows a first packing element 201A produced by folding the sheet 101A.

The first sheet 101A of corrugated paper has such a construction, and can be folded into the first packing element 201A of FIG. 3. Major folding steps are (1) folding the two inner side wall members 1T and 2T upwardly from the major folding lines A1 and A2, respectively, until these members 1T and 2T have come to upright positions and then (2) folding the two outer side wall members 1S and 2S downwardly from the respective folding lines B1 and B2 such that these members 1S and 2S are located back to back with the respective inner side wall members 1T and 2T. Two double-wall structures are thus provided on opposed sides. The support wall member 6 is folded upwardly from the folding line E into an upright position. Through these folding steps, the support wall member 6 almost automatically stands by means of both the folding line E and the two L-shaped openings 7, 7 and at the same time the support surface member 4 almost automatically makes right angles with both the support wall member 6 and the left-hand inner side wall member 1T by virtue of the parallel folding lines C and D and the parallel cuts 5, 5. The projecting piece 10 is folded outwardly until it has come to a horizontal position, as shown in FIG. 3. The cushion members 13A and 13B are folded upright from the respective folding lines G1 and G1. The cushion members 13A and 13B are also folded along the respective folding lines G2 and G2 such that the narrow portions 13*a*, 13*a* of these members 13A and 13B come to horizontal positions. Each end member (16A and 16B) is folded along the two folding lines H1 and H2 into the shape of L.

The first packing element 201A of FIG. 3 is thus formed. In particular, this packing element has inner cushion members 13A and 13B that are particularly effective in protecting a product 400 (FIG. 19) held by a packing 300A (of FIG. 6) from shock. The relatively large openings 9, 9, now positioned in vertical planes inside the outer side wall member 1S, will receive projecting portions of the product 400. Reference numeral d of FIG. 3 designates an opening that was produced because the projecting portion 18 of the outer side wall member 2S came to an right position. This opening d will serve a purpose that will be described hereafter. The first packing element 201A also has a recess e in one of its side walls, or the side wall formed of the left-hand inner and outer side wall members IT and 1S of FIG. 1, because the projecting piece 10 was folded outwardly. This recess e also will serve a purpose that will become apparent hereafter.

Figure 4:
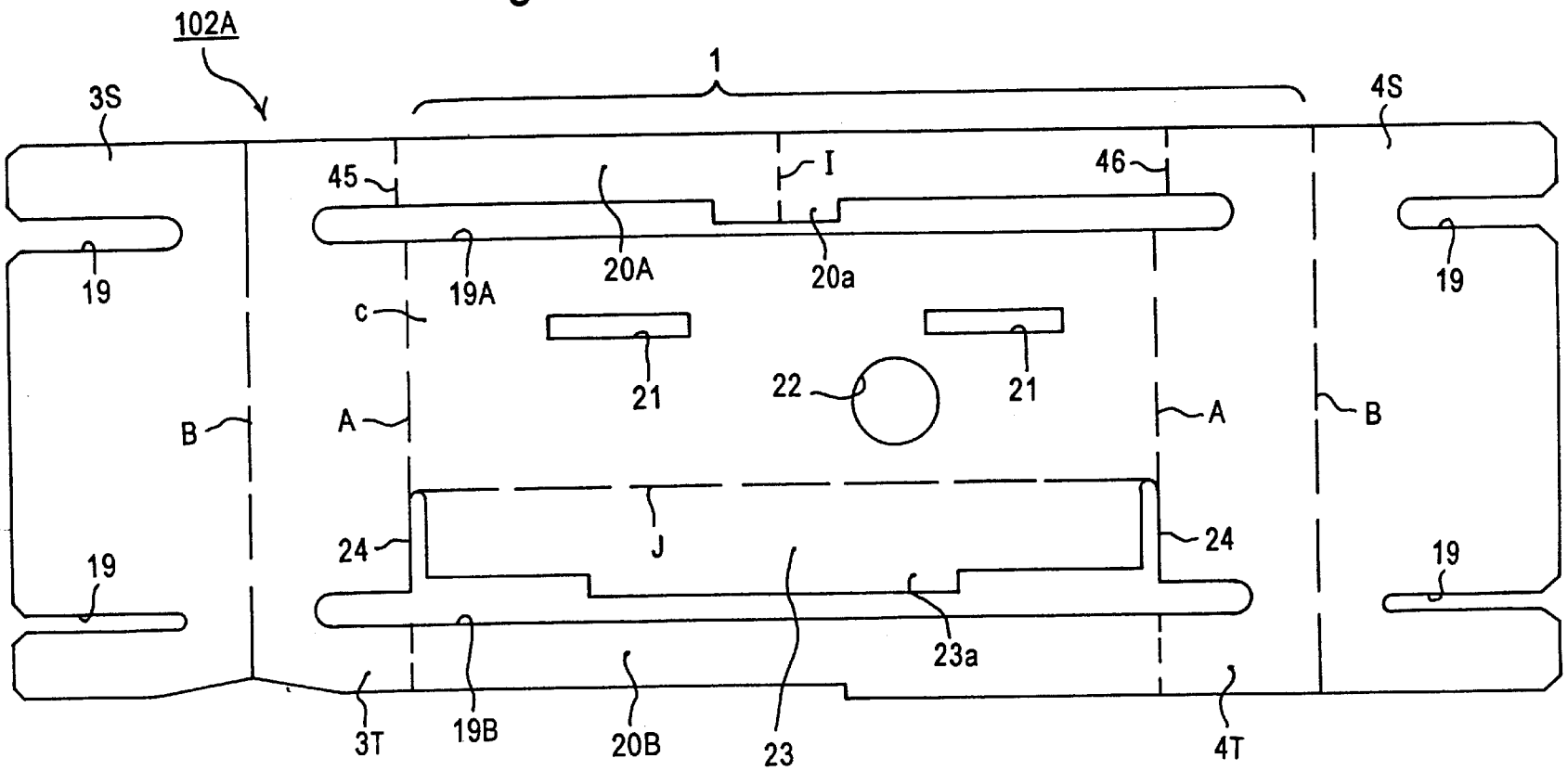
FIG. 4 is a plan view of a second flat sheet 102A of corrugated paper according to the invention.

FIG. 4 shows a second sheet 102A of corrugated paper prepared according to the invention. This sheet 102A can be folded into a second packing element 202A of FIG. 5. The sheet 102A has a central, rectangular bottom member c. Two rectangular slits 21, 21 are formed in the bottom member c. These slits 21, 21 receive the respective end portions 6*a*, 6*a* of the support wall member 6 of the first packing element 201A when the second packing element 202A is mounted in the first packing element 201A to assemble a first packing 300A of FIG. 6. Also, a circular opening 22 is formed therein. A support wall member 23 is provided on one side of the bottom member c, and is divided from the bottom member c by a longitudinally-extending folding line J. The support wall member 23 has a projecting portion 23*a* with the same length as the slit 8 of the first sheet 101A for insertion into the same slit 8. An elongated side member 20B is located adjacent to the support wall member 23, and is separated from the support wall member 23 by a longitudinally-extending slit 1B. The support wall member 23 is defined partly by transversely-extending short slits 24, 24 that are continuous with the slit 19B. On the opposed side of the side member 20B is located another elongated side member 20A that is separated from the bottom member c by an elongated slit 19A. This side member 20A has a transversely-extending folding line I at its center. Also the side member 20A has a projecting portion 20*a*. Two parallel major folding lines A, A are provided. Each major folding line A, however, is interrupted by the slit 19B. The right-hand major folding line A divides both the bottom member c and the side member 20B from a right-hand inner end wall member 4T. Similarly, the left-hand major folding line A divides both these members c and 20B from a left-hand inner end wall member 3T. The side member 20A is divided from the left and right inner end wall members 3T and 4T by folding lines 45 and 46, respectively. These folding lines 45 and 46 are located somewhat more outwards than the major folding lines A, A. Each elongated slit (19A and 19B) extends into the inner end wall members 3T and 4T at its respective ends. A right-hand outer end wall member 4S is provided adjacent to the right-hand inner end wall member 4T, and is divided from the latter member 4T by a folding line B. Similarly, a left-hand outer end wall member 3S is provided adjacent to the left-hand inner end wall member 3T, and is divided from the latter member 3T by another folding line B. Each outer end wall member (4S and 3S) has two longitudinally-extending slits 19, 19. One of the slits 19, 19 of each outer end wall member is aligned with the first elongated slit 19A, and the other slit 19 of each outer end wall member is in alignment with the second elongated slit 19B.

Figure 5:
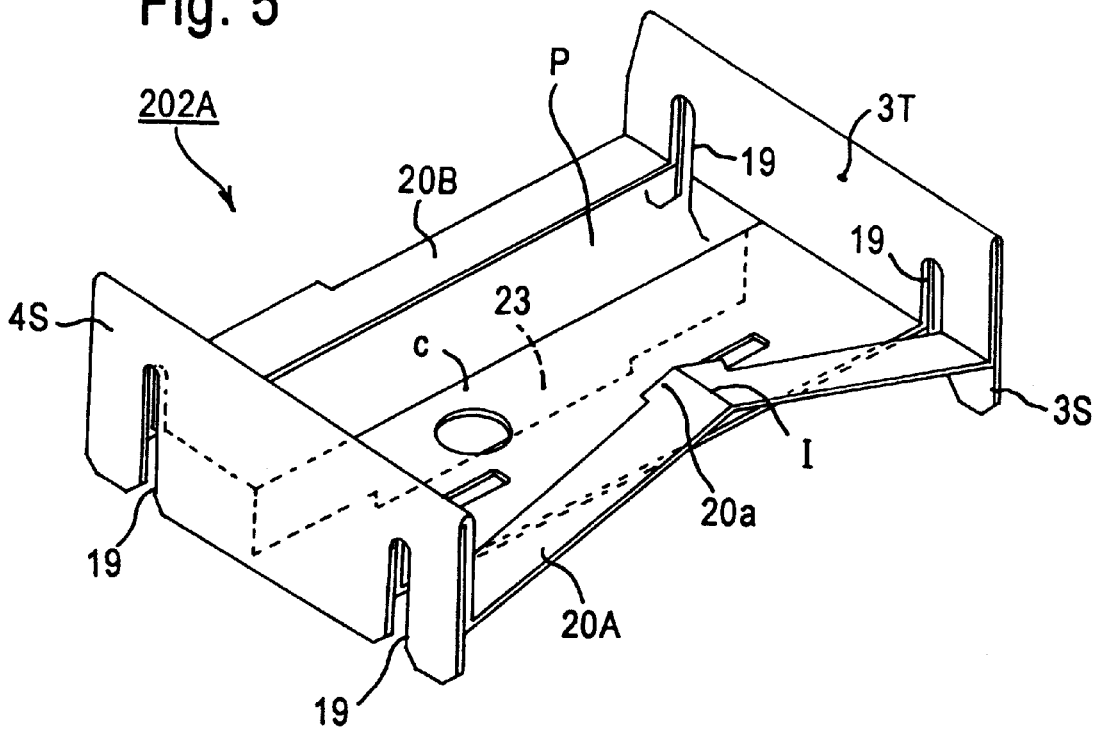
FIG. 5 shows a second packing element 202A produced by folding the sheet 102A of FIG. 4.

The second sheet 102A of corrugated paper has such a construction, and can be folded into the second packing element 202A of FIG. 5, as follows. The support wall member 23 is folded downwardly from the folding line J until the support wall member 23 has come to a vertical position. Then, each inner end wall member (3T and 4T) is folded upwardly from one of the folding lines A, A, as well as one folding line 45 or 46, into an upright position. Next, each outer end wall member (3S and 4S) is folded outwardly from one of the folding lines B, B such that the outer end wall member comes into contact with the outer surface of the inner end wall member 3T or 4T. Then, the side member 20A is folded along the folding line I such that the folding line I comes to an upper position. The second packing element 202A of FIG. 5 with a space P is thus formed.

Figure 6:
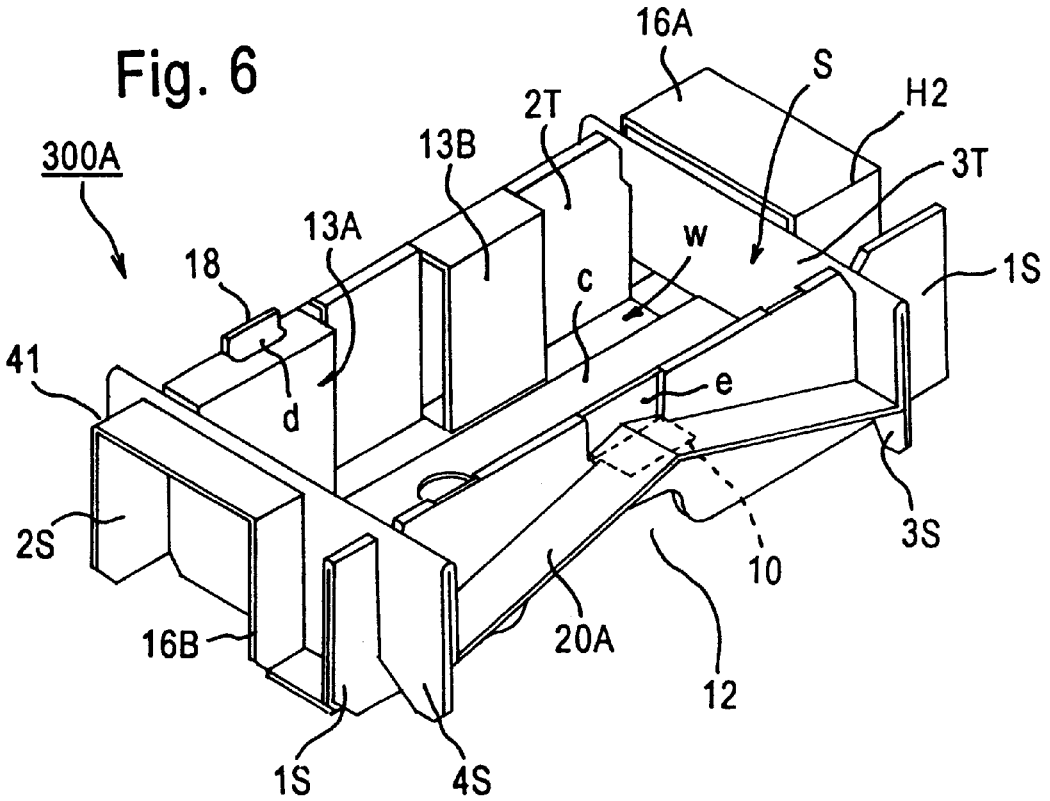
FIG. 6 shows a first packing 300A assembled by mounting the second packing element 202A of FIG. 5 in the first packing element 201A of FIG. 3.

Then, the second packing element 202A of FIG. 5 can be mounted, as follows, in the first packing element 201A of FIG. 3 to form a packing 300A of FIG. 6. The two slits 19, 19 of the outer end wall member 4S, one slit 19 now providing one opening with one end of the first elongated slit 19A and the other slit 19 now providing one opening with one end of the second elongated slit 19B, are engaged with one of the slits 3 of the packing element 201A and the slit 15B of-the same packing element 202A, respectively. At the same time, the two slits 19, 19 of the other outer end wall member 3S are engaged with the other slit 3 of the first packing element 201A and the slit 15A of the same packing element 201A, respectively. Also, at the same time, the two slits 21, 21 of the bottom member c of the second packing element 202A are mated with the respective projecting portions 6*a*, 6*a* of the support wall member 6 of the first packing element 201A, so that those projecting portions 6*a*, 6*a* are received by the respective slits 21, 21. The downwardly projecting portion 23*a* of the support wall member 23 of the second packing element 202A is inserted into the slit 8 of the first packing element 201A. The projecting portion 20*a* of the side member 20A is engaged with the recess e of the first packing element 201A. Through these steps, the bottom member c of the second packing element 202A automatically becomes seated on the support surface member 4 of the first packing element 201A. In other words, that bottom member c becomes partly supported on the support surface member 4. At the same time the central portion of the side member 20A of the second packing element 202A, including the folding line I, becomes supported by the projecting piece 10 of the first packing element 201A. Also, at the same time, the side member 20B of the second packing element 202A automatically becomes positioned outside the outer side wall member 2S of the first packing element 201A. The cushion members 13A and 13B of the first packing element 201A, as well as one side wall thereof (consisting of the right-hand inner and outer side wall members 2T and 2S of FIG. 1), project upwardly from the space P of the second packing element 202A. The packing 300A of FIG. 6 with an inner space S is thus obtained.

Figure 12:
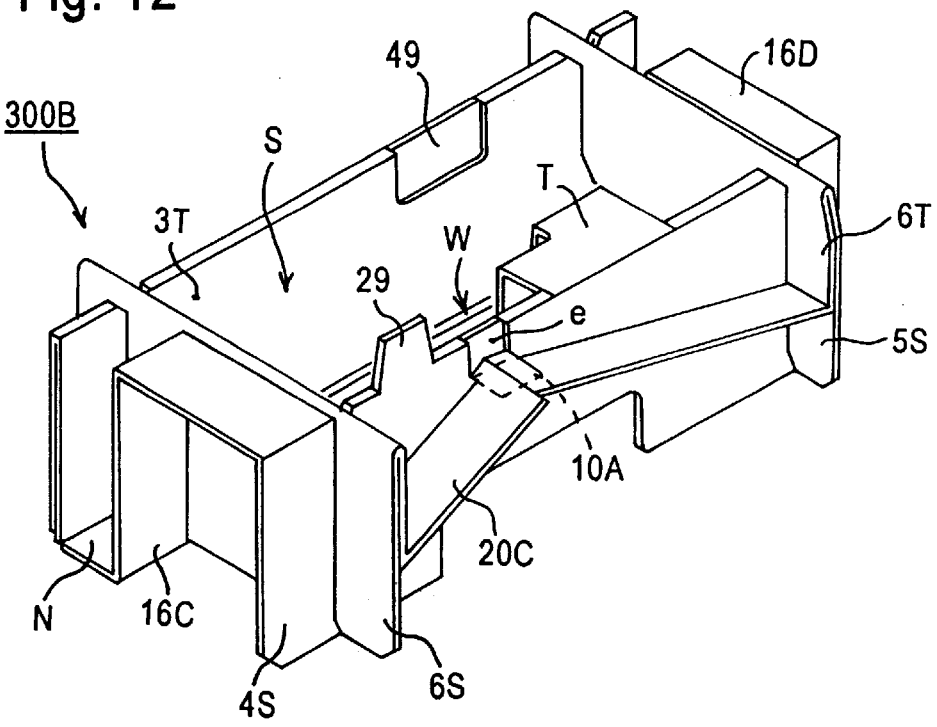
FIG. 12 shows a second packing 300B assembled by mounting the fourth packing element 202B of FIG. 11 in the third packing element 201B of FIG. 9.
Figure 19:
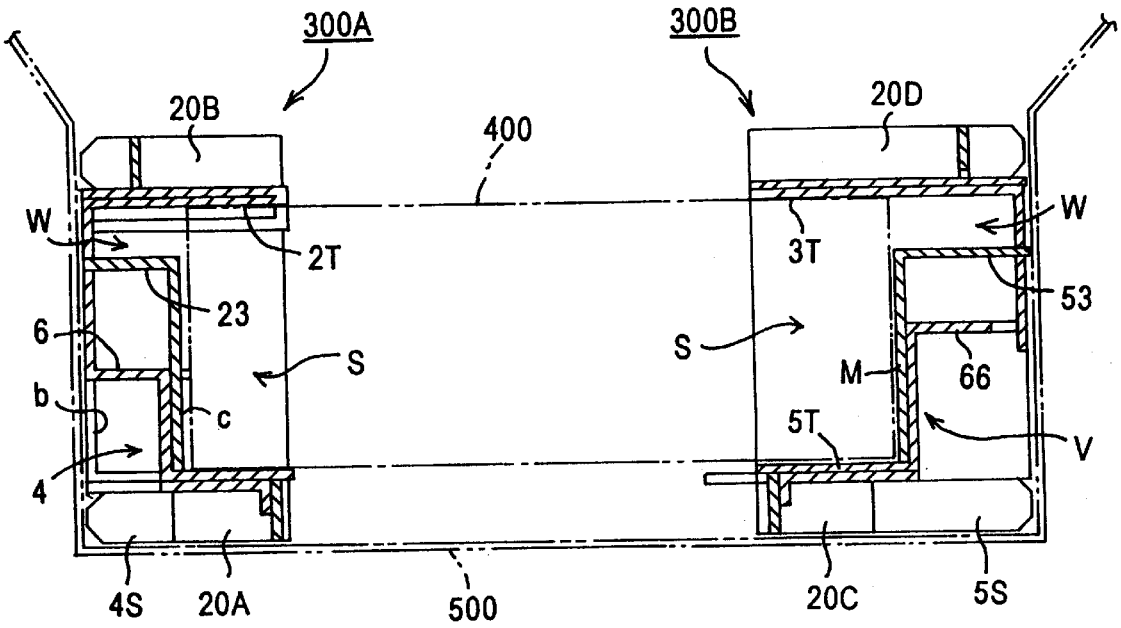
FIG. 19 shows a product 400 of a rectangular or similar shape that is held by the packings 300A and 300B at its opposed end portions or opposed side portions. In this Figure, the product 400 so held by the packings 300A and 300B is put into a cardboard box for shipment.

The inner space S can receive one end portion or one side portion of a product 400 of a rectangular or similar shape, as illustrated in FIG. 19. To say in advance, as shown in FIG. 19, the opposed end or side of the product 400 is received in a corresponding space S of a second packing 300B (of FIG. 12) assembled as hereinafter described. Also, the packing 300A has another inner space W into which one can put accessories for the product 400.

As described above, the cushion members 13A and 13B of the packing 300A are particularly effective in protecting the product 400 from shock. Also, as the side member 20A is in contact with one side wall (consisting of the outer and inner side wall members 1S and 1T) of the first packing element 201A not in a straight state but in a condition bent downwardly from the folding line I, the same member 20A functions to distribute shock from the outside over the entire surface of that side wall, instead of allowing the shock to focus on a particular localized portion of that side wall. Also, as the projecting portion 20*a* of the side member 20A is received in the recess e, the side member 20A is prevented from being displaced. The end members 16A and 16B of the first packing element 201A protect the respective end wall members (3S, 3T and 4S, 4T) of the second packing element 202A from damage. One can put his finger into the circular opening 22 of the bottom member c to hold the packing 300A. Recess 12 of the packing 300A serves to reduce shock if it is given to the packing 300A.

Figure 7:
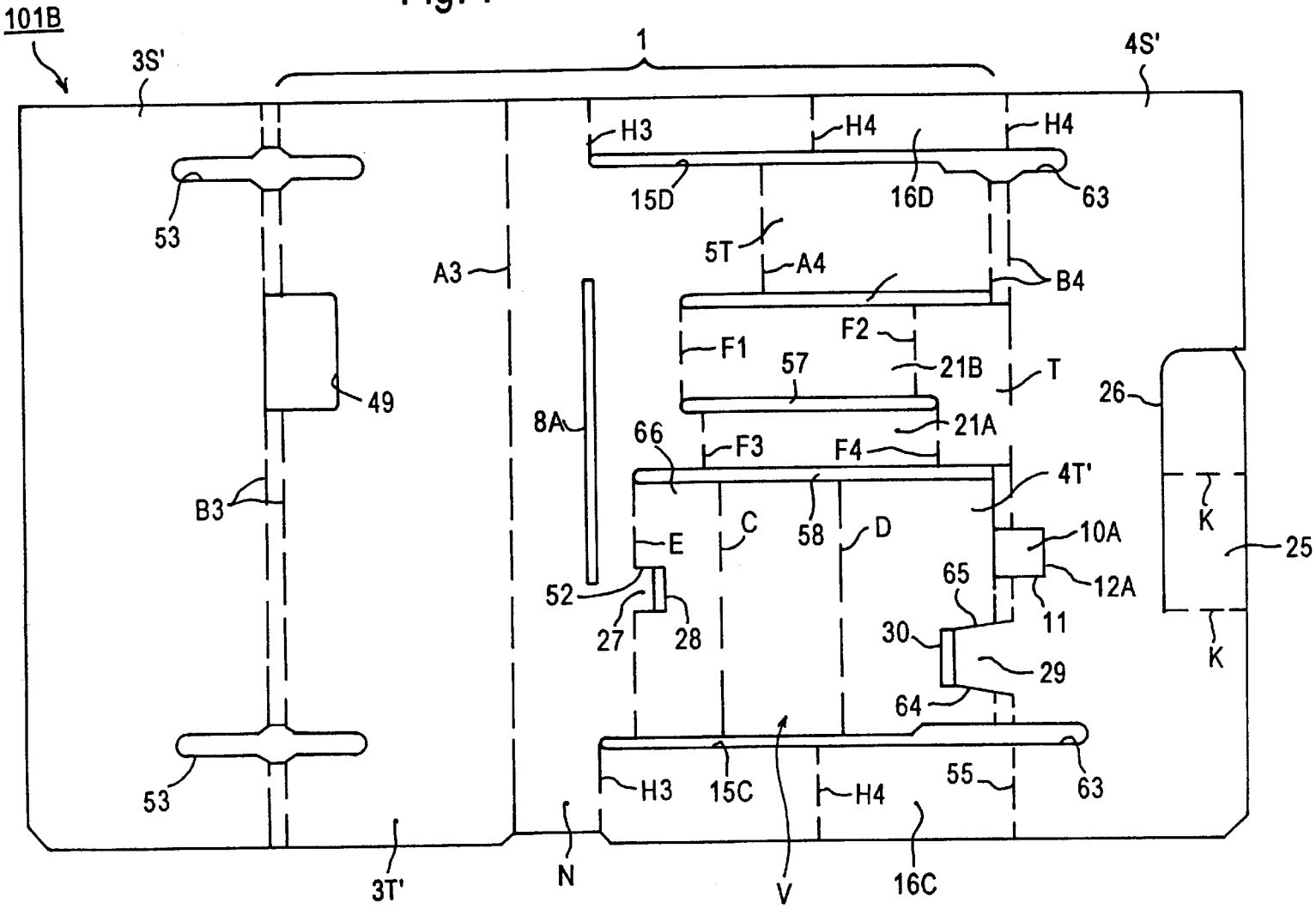
FIG. 7 is a plan view of a third flat sheet 101B of corrugated paper according to the invention.
Figure 8:
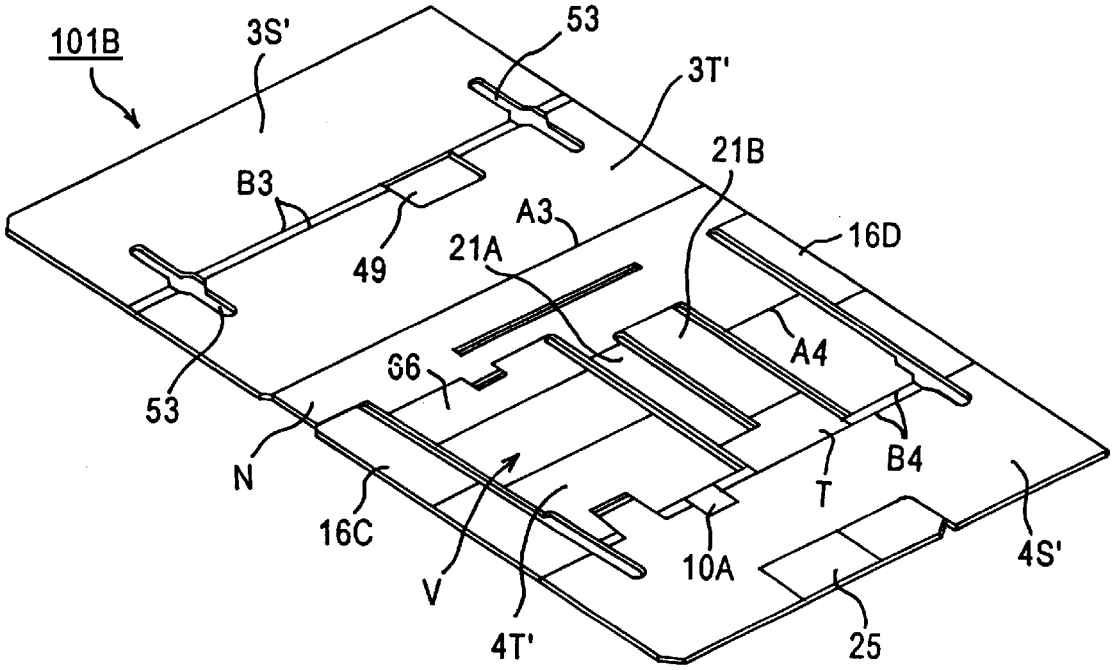
FIG. 8 is a perspective view of the third flat sheet 101B of FIG. 7.

FIG. 7 shows a third flat sheet 101B of corrugated paper also prepared according to the invention. FIG. 8 is a perspective view of the same sheet 101B. This sheet 101B can be folded into a third packing element 201B of FIG. 9. To say in advance, the third packing element 201B can be joined with a fourth packing element 202B of FIG. 11 to provide a second packing 300B of FIG. 12.

As shown, the sheet 101B of FIG. 7 has a left-hand half that resembles the left-hand half of the first sheet 101A, but the right-hand half of the sheet 101B differs materially from the right-hand half of the first sheet 101A. The sheet 101B includes a centrals bottom member N. This member N has a slit 8A. On the left side of the bottom member N is located an inner side wall member 3T' that is divided from the bottom member N by a folding line A3. This inner side wall member 3T' will be referred to as a "first inner side wall member" for convenience's sake. On the left side of the inner side wall member 3T' is located an outer side wall member 3S' that is divided from the inner side wall member 3T' by a double folding line B3. Two slits 53, 53 intersect the double folding line B3 and, hence, interrupt this folding line B3. As illustrated, one slit 53 is located near one edge of the sheet 101B, and the other slit 53 is positioned near the opposed edge of the sheet 101B. Both the slits 53, 53 extend into the inner and outer side wall members 3T' and 3S'. Reference numeral 49 designates a square opening that starts from an outer line of the double folding line B3 and extends into the inner side wall member 3T'.

The sheet 101B also has a right-hand outer side wall member 4S' as a rightmost member. The right-hand outer side wall member 4S' corresponds to the left-hand outer side wall member 3S'. A support piece member 25 is embraced by the outer side wall member 4S', and is defined by a cut 26 shaped like "L" and a folding line K. Another folding line K is also provided in the support piece member 25. Between the right-hand outer side wall member 4S' and the central, bottom member N are located the following members:

first and second end members 16C and 16D second inner side wall member 4T' support surface member V support wall member 66 first cushion member 21A second cushion member 21B top member T third inner side wall member 5T The first end member 16C is defined by a folding line H3, slit 15C, and folding line 55, and is divided from the right-hand outer side wall member 4S' by that folding line 55. The first end member 16C also has a folding line H4. The slit 15C has a larger portion 63.

The second inner side wall member 4T' is for the most part defined by the slit 15C, a second (right-hand) double folding line B4, a slit 58, and a folding line D.

The support surface member V is located between the second inner side wall member 4T' and the support wall member 66, and is defined by the slits 15C and 58 and folding lines D and C.

The support wall member 66 is defined by the slits 15C and 58, folding lines C and E, a slit 28, and two cuts 52, 52.

The first cushion member 21A is defined by the slit 58, folding lines F3 and F4, and a slit 57.

The second cushion member 21B is defined by slits 57 and 56 and folding lines F1 and F2, and is located more right than the first cushion member 21A.

The top member T is mostly defined by the slits 58, 57 and 56, folding lines F4 and F2, and an outer line of the right-hand double folding line B4.

The third inner side wall member 5T is defined by slits 56 and 15D, the double folding line B4, and a folding line A4.

The second end member 16D is defined by the slit 15D and folding lines H3 and 54, and is divided from the right-hand outer side wall member 4S' by the folding line 54. The second end member 16D also has a folding line H4. The slit 15D has a larger portion 63.

The central, bottom member N has a projecting portion 27 that is defined by the cuts 52, 52 and slit 28.

A slit 30 is provided between the right-hand outer side wall member 4S' and second inner side wall member 4T'. This slit 30, together with inclined cuts 64 and 65, defines a projecting portion 29 of the right-hand outer side wall member 4S'.

Also, a square projecting piece 10A is provided between the second inner side wall member 4T' and right-hand outer side wall member 4S'. This projecting piece 10A is defined at its three sides by a cut 11A and at its remaining one side by a folding line 12A.

As illustrated, the right-hand double folding line B4 is interrupted by the top member T, projecting piece 10A, and the projecting portion 29 of the right-hand outer side wall member 4S'.

Reference numeral 1 of FIG. 1 designates a body of the sheet 101B.

The third sheet 101B has such a construction, and can be folded into the third packing element 201B of FIG. 9, as follows. The first inner side wall member 3T' is folded upright from the folding line A3, and the left-hand outer side wall member 3S' is folded outwardly from the left-hand double folding line B3 until the left-hand outer side wall member 3S' has come to a vertical position. In other words, the two members 3T' and 3S' are folded such that the two members 3T' and 3S' stand back to back with each other. This folding step gives one side wall of the third packing element 201B. Then, the right-hand half of the sheet 101B is folded into an upright position from the six transversely-extending folding lines H3, A4, F1, F3, E, and H3, and the two end members 16C and 16D are folded outwardly from the folding lines H4 into horizontal positions. The two end members 16C and 16D are thus shaped like "L." The top member T is folded outwardly from the folding lines F2 and F4 into a horizontal position. The support surface member V is also folded outwardly from the folding line C into a horizontal position. The second inner side wall member 4T' is folded upright from the folding line D. The right-hand outer side wall member 4S' is folded from the right-hand double folding line B4 into a vertical position. The projecting piece 10A is folded outwardly from the folding line 12A into a horizontal position. Lastly, the support piece member 25 is folded from the folding lines K, K into the shape of "L," and is engaged with the projecting portion 27 of the bottom member N.

Figure 9:
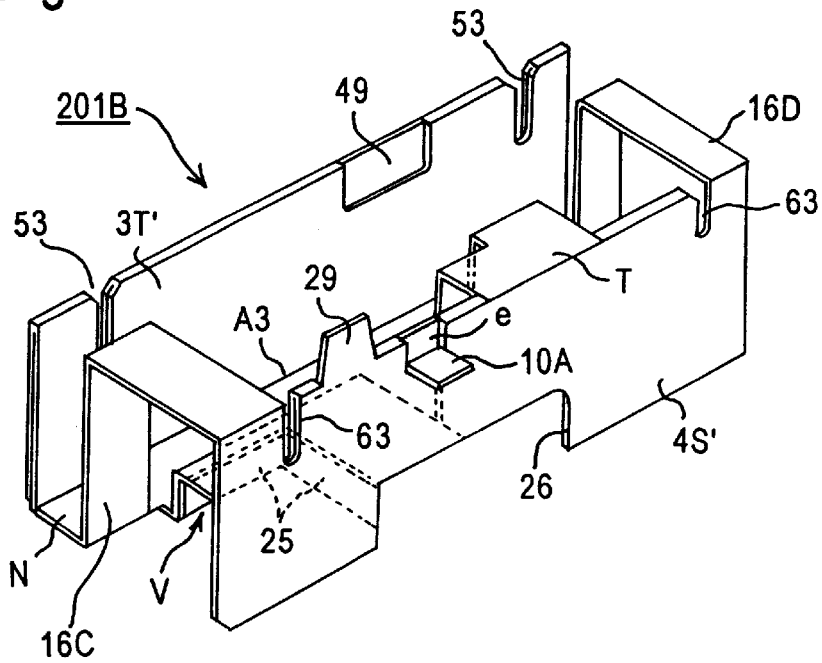
FIG. 9 shows a third packing element 201B produced by folding the third flat sheet 101B.

The third packing element 201B of FIG. 9 is thus formed. The L-shaped end members 16C and 16D, together with the end portions of the second outer side wall member 4S', constitute opposed gate-shaped end portions of the completed packing element 201B. It will be appreciated that the left-hand inner side wall member 3T' (first inner side wall member) and the left-hand outer side wall member 3S' constitute one side wall of the packing element 201B while the two right-hand inner side wall members, namely, the second and third inner side wall members 4T' and 5T and the right-hand outer side wall member 4S' constitute an opposed side wall of the packing element 201B. This opposed side wall has a recess e, since the projecting piece 10A was folded outwardly. This recess e will serve a similar purpose to the recess e of the first packing element 201A of FIG. 3. Since in the sheet 101B the second cushion member 21B is located more left than the first cushion member 21A, the former 21B, now being in an upright position, is positioned more inwards than the latter 21A, also now being in an upright position, in the completed packing element 201B.

Figure 18:
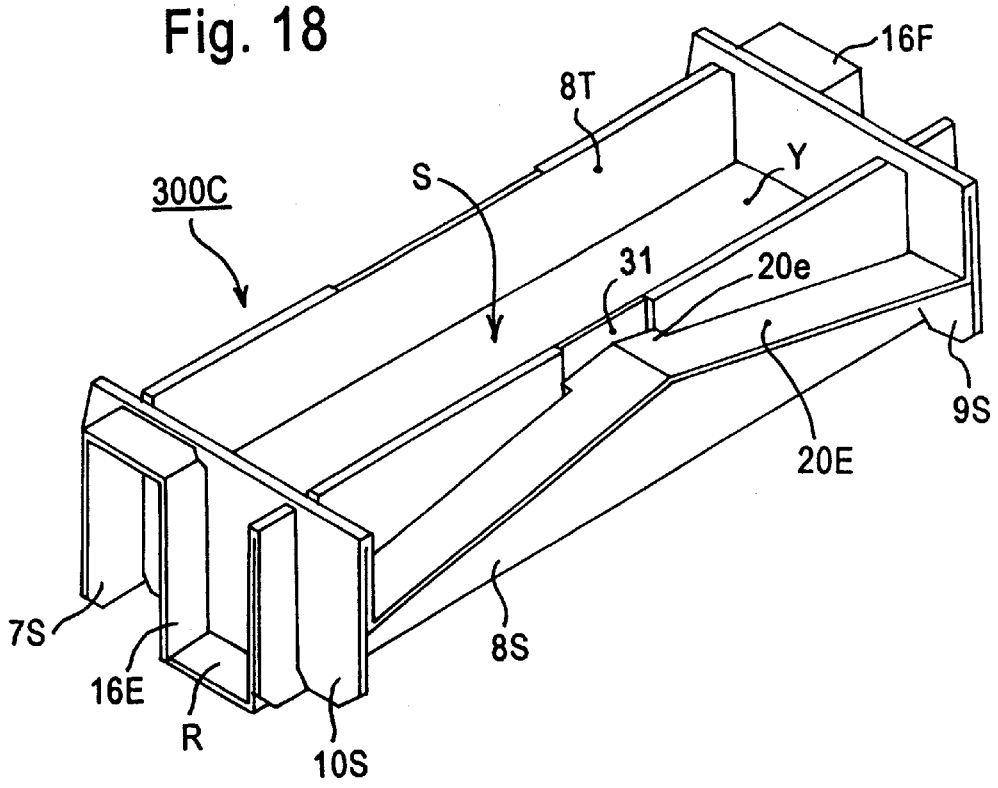
FIG. 18 shows a packing 300C assembled by mounting the packing element 202C of FIG. 17 in the packing element 201C of FIG. 15.

Like the cushion members 13A and 13B of the first packing element 201A, the cushion members 21A and 21B are particularly effective in protecting a product 400 (of FIG. 18) held by a packing 300B (of FIG. 12) from shock. The support piece member 25 is now in contact with the bottom of the support surface member V and, hence, the former 25 is now supporting the latter V from below.

Figure 10:
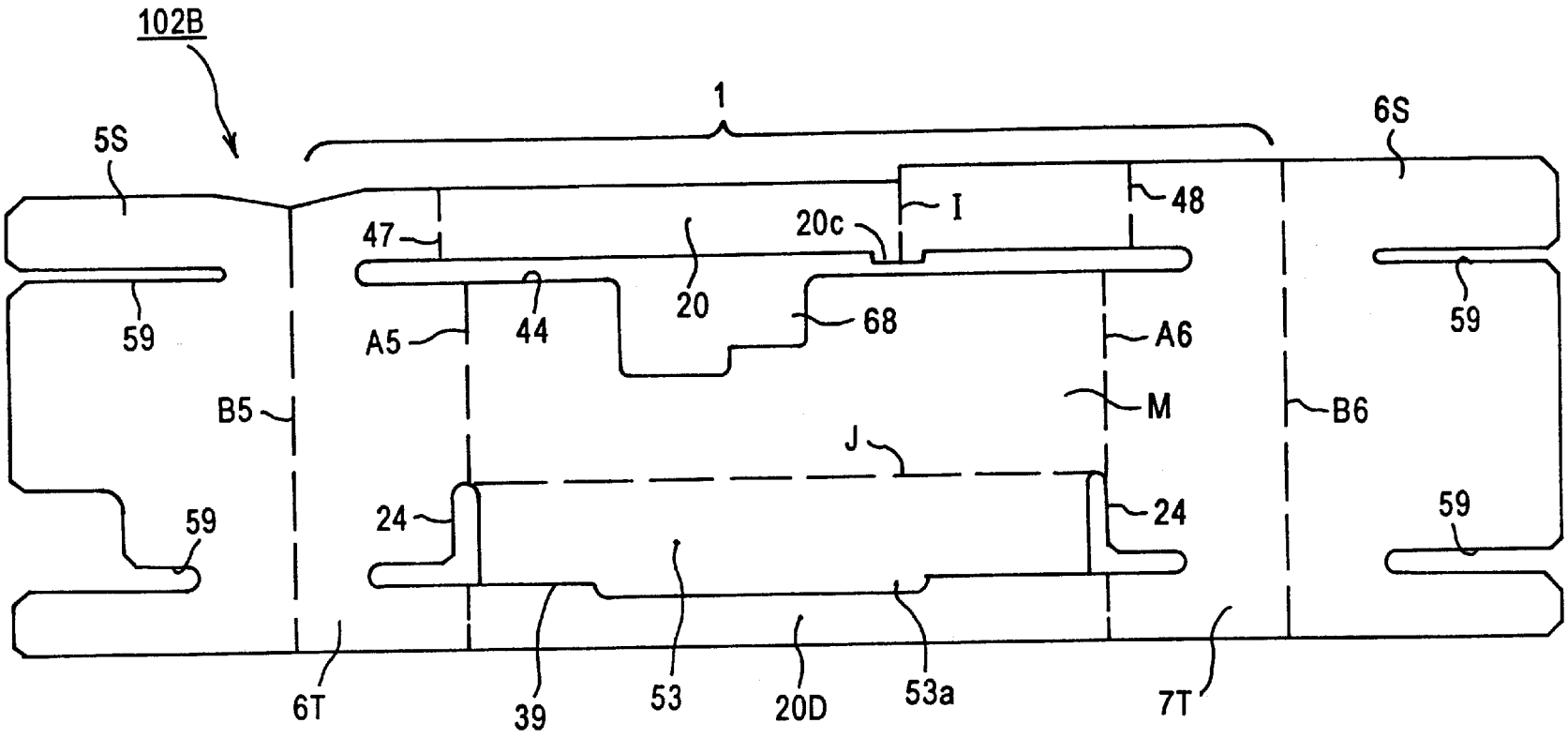
FIG. 10 is a plan view of a fourth flat sheet 102B of corrugated paper according to the invention.

FIG. 10 shows a fourth flat sheet 102B of corrugated paper prepared according to the invention. This sheet 102 can be folded into a fourth packing element 202B of FIG. 11, which can be mounted in the third packing element 201B of FIG. 9 to provide a second packing 300B of FIG. 12. As illustrated in FIG. 10, the sheet 102B is quite similar to the sheet 102A of FIG. 4. The sheet 102B includes a central, body section 1. This body section 1 has a longitudinally-extending bottom member M that is defined by a folding line J, two parallel folding lines A5 and A6, a slit 44, and an opening 68. A support wall member 53 is located adjacent to the bottom member M, and is divided from the same member M by the folding line J. The support wall member 53 has a projecting portion 53*a*. Two opposed longitudinally-extending side members 20C and 20D are provided with the bottom member M and support wall member 53 between. A first side member 20C is separated from the bottom member M by the slit 44 and opening 68, and has a folding line I. The first side member 20C also has a projecting portion 20*c* that is associated with the folding line I. A second side member 20D is divided from the support wall member 53 by a cut 39. Two L-shaped openings 24', 24', are provided with the support wall member 53 between. The folding line A5 is interrupted by one opening 24, and the folding line A6 by the other opening 24. One inner end wall member 6T or 7T is provided on each of the right and left sides of the bottom member M. One of the L-shaped openings 24', 24' extend into one inner end wall member 6T or 7T. Similarly, the slit 44 extends into both the inner end wall members 6T and 7T. The left-hand inner end wall member 6T is divided from the bottom member M and side member 20D by the folding line A5 and divided from the side member 20C by a folding line 47. Similarly, the right-hand inner end wall member 7T is divided from the bottom member M and side member 20D by the folding line A6 and divided from the side member 20C by a folding line 48. The folding lines 47 and 48 are located somewhat more outwards than the folding lines A5 and A6. An outer end wall member 5S is located outside of the left-hand inner end wall member 6T, and is divided from the latter 6T by a folding line B5. Similarly, an outer end wall member 6S is provided outside of the right-hand inner end wall member 7T and is divided from the latter 7T by a folding line B6. Each outer end wall member has a pair of slits 59, 59. One slit 59 of each outer end wall member is aligned with the slit 44, and the other slit 59 thereof is aligned with one straight portion of one of the slits 24', 24'. The opening 68 is formed continuously with the slit 44. Also, this opening 68 is formed into a similar shape to the top member T of the third packing element 201B (FIG. 9), since the top member T and cushion members 21A and 21B will have to pass that opening 68 when the fourth packing element 202B (FIG. 11) is mounted in the third packing element 201B (FIG. 9).

Figure 11:
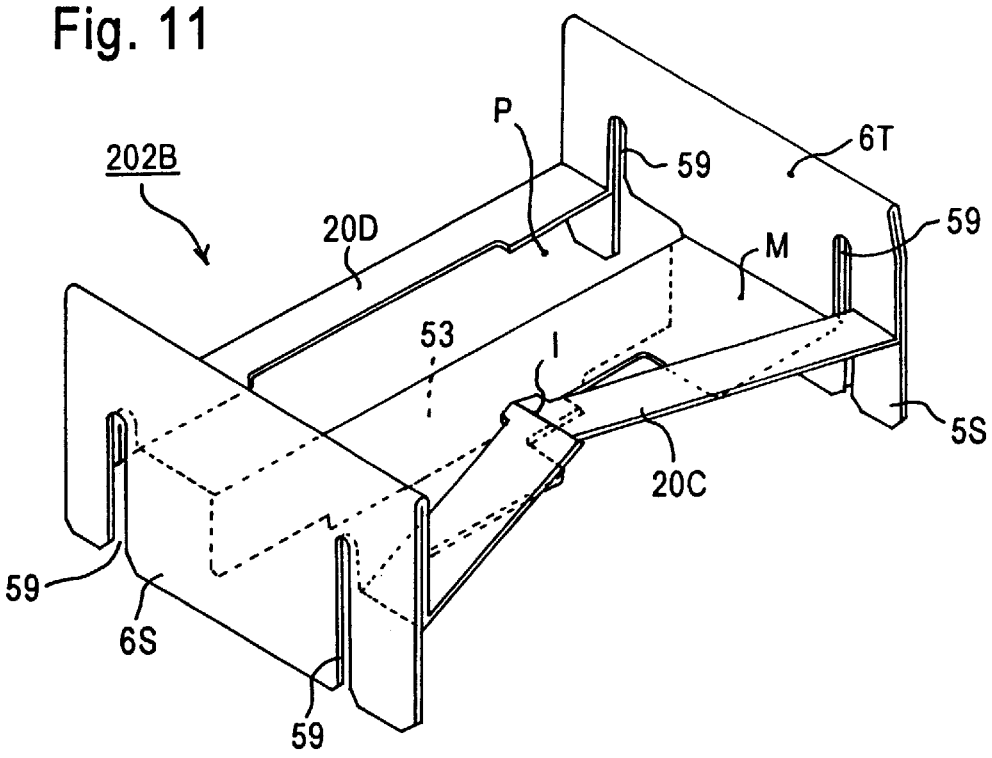
FIG. 11 shows a fourth packing element 202B produced by folding the fourth flat sheet 102B of FIG. 10.

The fourth sheet 102B has such a construction, and can be folded into the fourth packing element 202B of FIG. 11, as follows. The support wall member 53 is folded downwardly from the folding line J into a vertical position. Then, the two inner end wall members 6T and 7T are folded upwardly from the folding lines A5 and A6, as well as the folding lines 47 and 48, into upright positions. Next, each outer end wall member (5S and 6S) is folded outwardly from the folding line B5 or B6 such that the outer end wall member comes into contact with the outer surface of the inner end wall member 6T or 7T. Then, the side member 20C is folded along the folding line I such that the folding line I comes to an upper position. The fourth packing element 202B with a space P, as well as the space 68, is thus formed.

Then, the fourth packing element 202B can be mounted in the third packing element 201B of FIG. 9, as follows. The two slits 59, 59 of the outer end wall member 5S of the fourth packing element 202B, one slit 59 now providing one opening with one straight portion of one of the L-shaped openings 24', 24' and the other slit 59 now also providing one opening with one end of the slit 44, are engaged with one of the slits 53, 53 of the third packing element 201B and one of the slits 63 thereof, respectively. At the same time, the two slits 59, 59 of the other outer end wall member 6S of the fourth packing element 202B, one slit 59 now forming one opening with one straight portion of the other of the L-shaped openings 24', 24' and the other slit 59 now also forming one opening with the opposed end of the slit 44, are engaged with the other slits 53 and 63 of the third packing element 201B, respectively. Also, at the same time, the projecting portion 53*a*. now projecting downwardly, of the support wall member 53 of the fourth packing element 202B is inserted into the slit 8A of the bottom member N of the third packing element 201B. The projecting portion 20*c* of the side member 20C of the fourth packing element 102B is engaged with the recess e of the third packing element 201B. Through these steps, the bottom member M of the fourth packing element 202B automatically becomes seated on the support surface member V of the first packing element 201A. In other words, that bottom member M becomes partly supported on the support surface member V. At the same time, a portion of the side member 20C of the fourth packing element 202B in the vicinity of the folding line I also becomes supported on the projecting piece 10A of the third packing element 201B. Also, at the same time, the side member 20D of the fourth packing element 202B automatically becomes positioned outside the outer side wall member 3S' of the third packing element 201B while at the same time one side wall (consisting of the inner and outer side wall members 3T' and 3S') of the third packing element 201B automatically projects upwardly from the opening P of the fourth packing element 202B. The horizontal top member T and vertical cushion members 21A and 21B of the third packing element 201B project upwardly from the opening 69 of the fourth packing element 202B. The second packing 300B of FIG. 12 with an inner space S is thus obtained.

The inner space S can receive one end portion or one side portion of the product 400 (FIG. 19) opposed to its one end portion or one side portion received by the first packing 300A. Thus, as illustrated in FIG. 19, the first and second packings 300A and 300B can be used to completely hold one product 400. Also, like the first packing 300A, the second packing 300B has another inner space W into which one can put accessories for the product 400. As described above, the cushion members 21A and 21B are particularly effective in protecting the product 400 from shock. Also, as the side member 20C is in contact with one side wall (consisting of the outer side wall member 4S' and inner side wall members 4T' and 5T) of the third packing element 201B not in a straight state but in a condition bent downwardly from the folding line I, the side member 20C functions to distribute shock from the outside over the entire surface of that side wall, instead of allowing the shock to focus on a particular localized portion of that side wall. Also, since the projecting portion 20*c* of the side member 20C is received in the recess e, the side member 20C is prevented from being displaced. The end members 16C and 16D of the third packing element 201B protect the respective end walls (6S, 7T and 5S, 6T) of the fourth packing element 202B against damage. The recess 49 of one side wall of the packing 300B receives a projecting portion of the product 400.

As described above, the first and second packings 300A and 300B can be employed as one set of packings to hold one product 400. Then, the upwardly projecting portion 29 of the second packing 300B can be inserted into the opening d of the first packing 300A to join the two packings together. If they are thus joined in advance, one can readily find one set of packings when necessary and, hence, he can readily apply them to the product 400. It will, however, be appreciated, particularly from the significant differences in construction between the flat sheets 101A (FIG. 1) and 101B (FIG. 7), the packings 300A and 300B are adapted to hold opposed end portions or opposed side portions of a product of a rectangular or similar shape that have different shapes.

Figure 13:
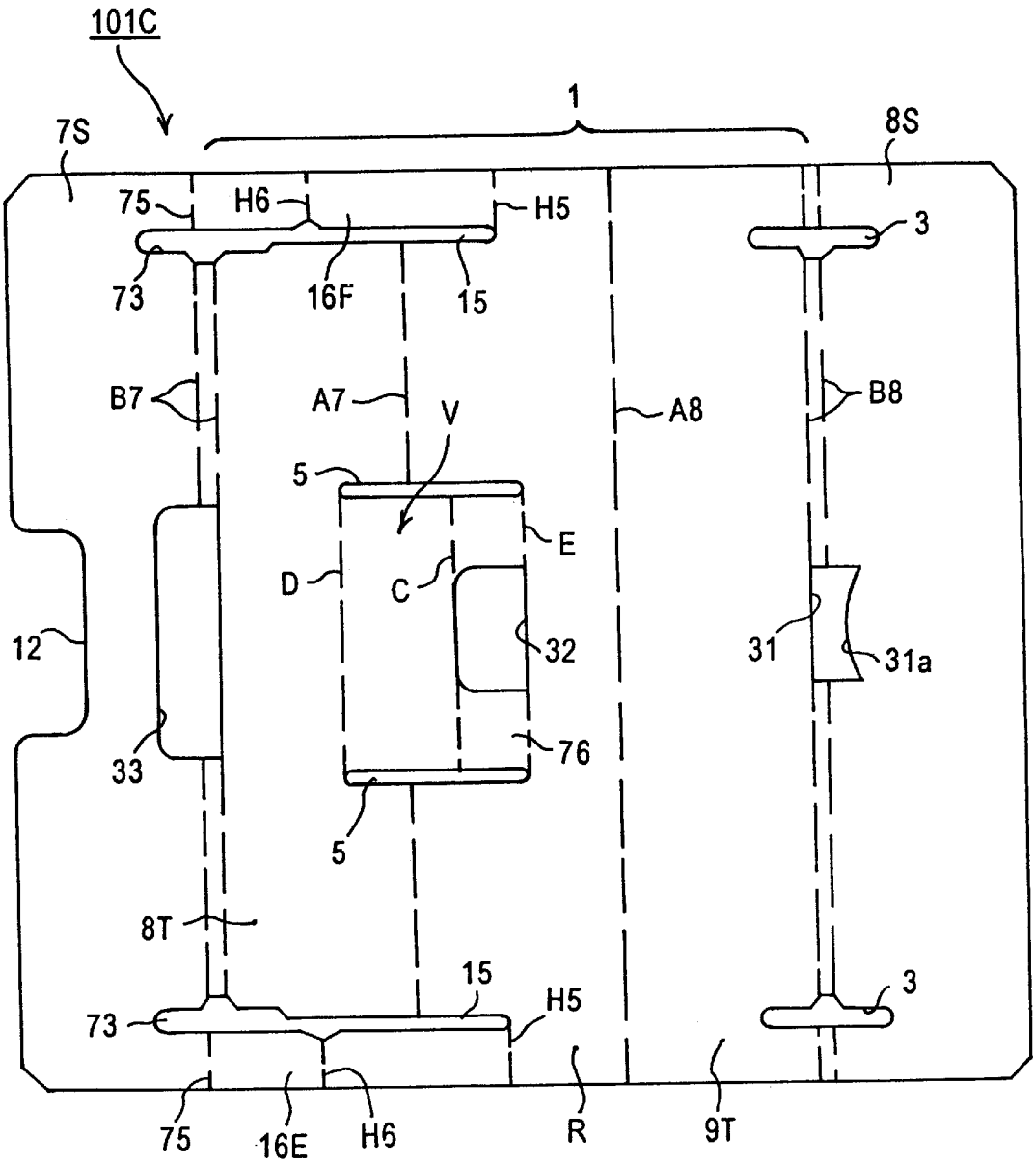
FIG. 13 is a plan view of another flat sheet 101C of corrugated paper according to the invention.
Figure 14:
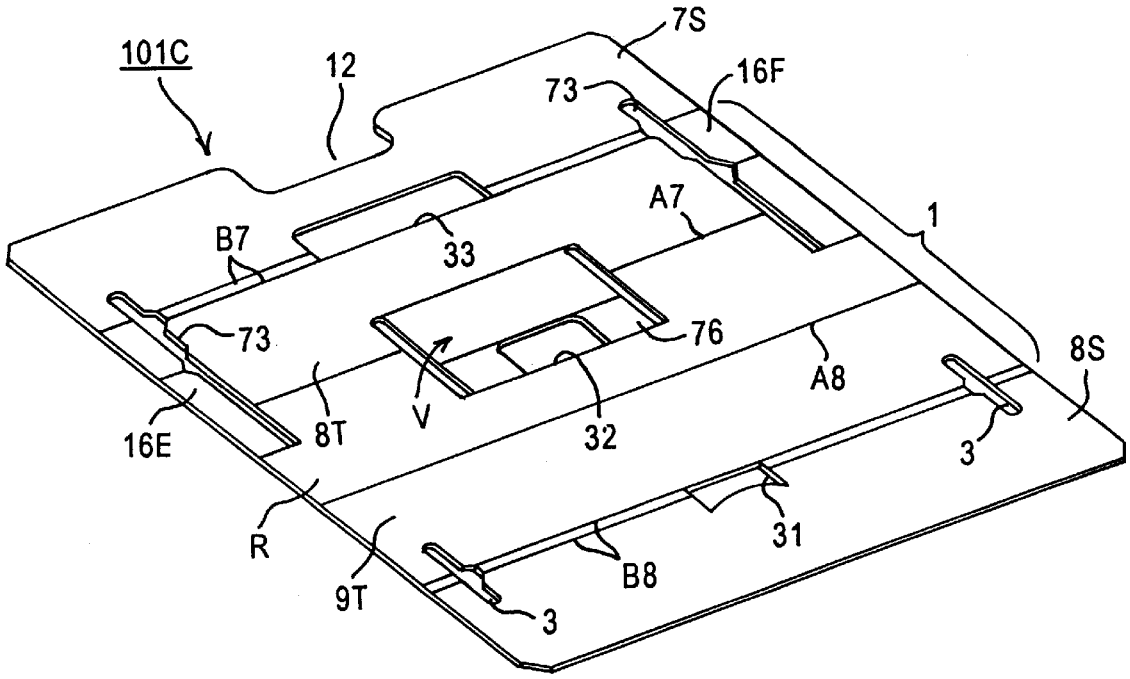
FIG. 14 is a perspective view of the sheet 101C of FIG. 13.

FIG. 13 shows another flat sheet 101C of corrugated paper prepared according to the invention. FIG. 14 is a perspective view of the sheet 11C. This sheet 101C can be folded into a primary packing element 201C of FIG. 15. A secondary packing element 202C of FIG. 17, which can be obtained by folding another flat sheet 102C of corrugated paper of FIG. 16, can be mounted in the primary packing element 201C to provide a packing 300C of FIG. 18.

The flat sheet 101C of FIG. 13 differs significantly from the sheet 101A of FIG. 1 in that the sheet 101C has no inner cushion members corresponding to those 13A and 13B of the sheet 101A, but, as is obvious from FIG. 13, the sheet 101C is rather similar to the sheet 101A in other respects. The sheet 101C includes a body section 1. The body section 1 has a bottom member R that is generally defined by two parallel folding lines A7 and A8. An inner side wall member 8T is located on the left side of the bottom member R. The inner side wall member 8T is divided from the bottom member R by the folding line A7. A support wall member 76 and support surface member V are embraced by the bottom member R and inner side wall member 8T. The support wall member 76 is defined by parallel folding lines E and C and parallel slits 5, 5. The support surface member V is divided from the support wall member 76 by the folding line C, and is defined by the same folding line C, a folding line D, and the slits 5, 5. The support wall member 76 has an opening 32. The folding line A7 is interrupted by the support surface member V and slits 5, 5. On the left side of the inner side wall member 8T is provided an outer side wall member 7S that is generally divided from the inner side wall member 8T by a double folding line B7. The outer side wall member 7S has a recess 12. The double folding line B7 is interrupted by an opening 33. First and second end members 16E and 16F are opposed to each other with the inner side wall member 8T between, and are located between the bottom member R and outer side wall member 7S. Each end member is defined by parallel folding lines H5 and 75 and slits 15 and 73. The two slits 15 and 73 are continuous with each other. Each end member also has a folding line H6. The slit 15 extends into the bottom member R, and the slit 73 extends into the outer side wall member 7S. On the right side of the bottom member R is located another inner side wall member 9T that corresponds to the left-hand inner side wall member 8T. The right-hand inner side wall member 9T is divided from the bottom member R by the folding line A8. Another outer side wall member 8S is located outside of the right-hand inner side wall member 9T. The right-hand outer side wall member 8S is divided from the right-hand inner side wall member 9T by a double folding line B8. The double folding line B8 is interrupted by two slits 3, 3 and a central opening 31. This opening 31 has a curved edge 31*a*.

Figure 15:
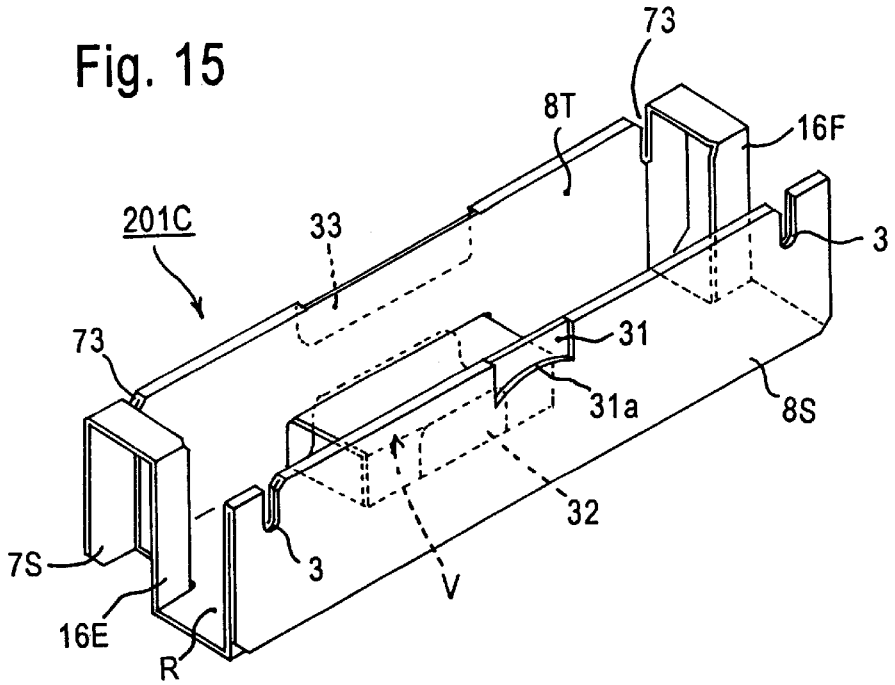
FIG. 15 shows a packing element 201C obtained by folding the flat sheet 101C of FIG. 13.

The sheet 101C has such a construction, and can be folded into the primary packing element 201C of FIG. 15. Major folding steps are (1) folding the left-hand inner and outer side wall members 8T and 7S along the folding lines A7 and B7 in such a manner that these members 8T and 7S stand back to back with each other and (2) folding the right-hand inner and outer side wall members 9T and 8S along the folding lines A8 and B8 in the same manner. Each end member is folded along the folding lines H5, H6, and 75 into the shape of "L." The support wall member 76 is folded upright from the folding line E. Through these folding steps, the support surface member V becomes located in a horizontal position that is perpendicular to the first inner side wall member 8T. The primary packing element 201C is thus produced.

Figure 16:
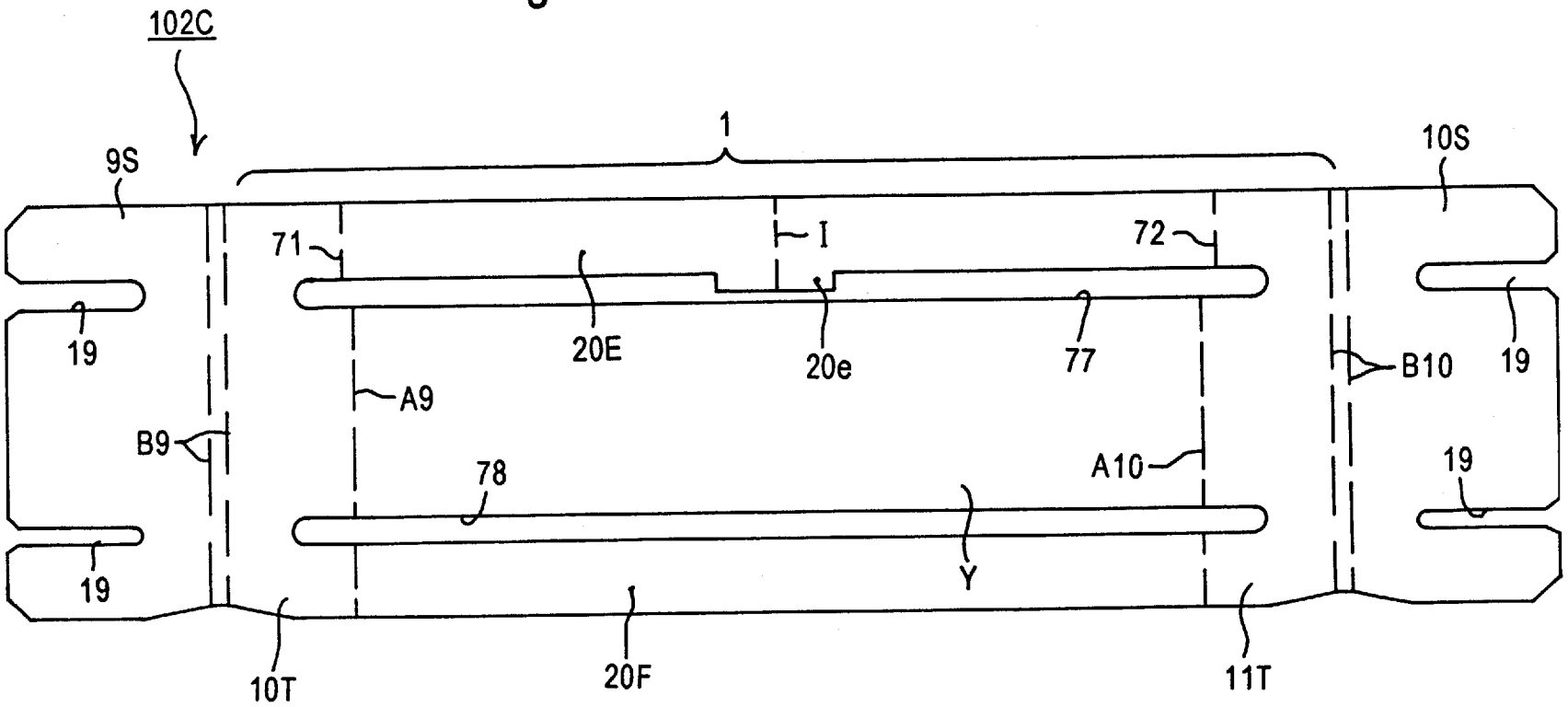
FIG. 16 is a plan view of still another flat sheet 102C of corrugated paper prepared according to the invention.

The flat sheet 102C of corrugated paper of FIG. 16 includes a central, bottom member Y. This bottom member Y is defined by parallel folding lines A9 and A10 and parallel slits 77 and 78. First and second side members 20E and 20F extend parallel to each other as well as the bottom member Y. The first side member 20E is separated from the bottom member Y by a slit 77, and the second side member 20F is separated from the bottom member Y by a slit 78. The first side member 20E has a central folding line I and projecting portion 20*e*. The folding lines A9 and A10 are interrupted by the slit 78. Inner end wall members 10T and 11T are located with the bottom member Y and side members 20E and 20F between. Both the slits 77 and 78 extend into both the inner end wall members 10T and 11T. The left-hand inner end wall member 10T is divided from the bottom member Y and side member 20F by the folding line A9 and from the side member 20E by a folding line 71. Similarly, the right-hand inner end wall member 11T is divided from the bottom member Y and side member 20F by the folding line A10 and from the side member 20E by a folding line 72. As illustrated, the folding lines 72 and 71 are located somewhat more outward than the folding lines A10 and A9. Outer end wall members 9S and 10S are located outside of the inner end wall members 10T and 11T, respectively. Each outer end wall member is divided from the adjacent inner end wall member by a double folding line B9 or B10. Each outer end wall member has recesses 19, 19.

Figure 17:
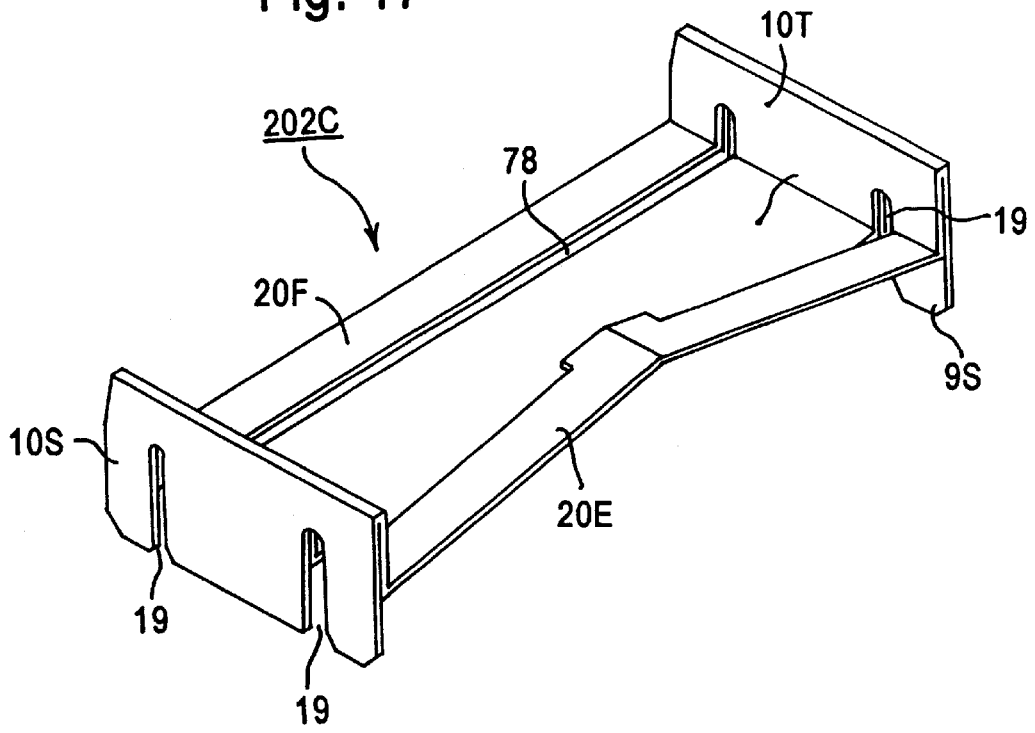
FIG. 17 shows a packing element 202C produced by folding the flat sheet 102C of FIG. 16.

The sheet 102C has such a construction, and can be made into a secondary packing element 202C of FIG. 17 by (i) folding the adjacent inner and outer end wall members (10T, 9S and 11T, 10S) from the folding lines A9 and B9 or A10 and B10 such that these adjacent members stand back to back with each other and (ii) folding the side member 20E along the folding lines 71, 72, and I such that the folding line I becomes a top of the side member 20E.

Then, the secondary packing element 202C can be mounted very readily in the primary packing element 201C. That is, two slits 19, 19 of the packing element 202C are engaged with one of the slits 73, 73 and one of the slits 3,3, respectively, of the packing element 201C and, at the same time, the remaining two slits 19, 19 of the packing element 202C are engaged with the other slits 73 and 3 of the packing element 201C. Also, at the same time, the projecting portion 20*e* of the side member 20E is placed on the curved edge 31*a* of the recess 31 of the packing element 201C. Through these steps, one side wall (consisting of the first inner and outer side wall members 8T and 7S) of the packing element 201C projects upwardly from the slit 78 of the packing element 202C and, at the same time, the bottom member Y of the packing element 202C becomes seated on the support surface member V of the packing element 201C. Also, the end members 16E and 16F, each now forming one gate-shaped end portion of the packing element 201C along with one end of the first outer side wall member 7S, take their positions outside the opposed end walls of the packing element 202C. A packing 300C of FIG. 18 with an inner space S is thus assembled.

The end members 16E and 16F serve to protect the opposed end walls of the packing element 202C against damage. The opening 32 of the packing element 201C serves to alleviate shock if it is given to the bottom member R from behind the same member R. Also, both the opening 33 and recess 12 of the packing element 201C serve similar purposes.

Figure 20:
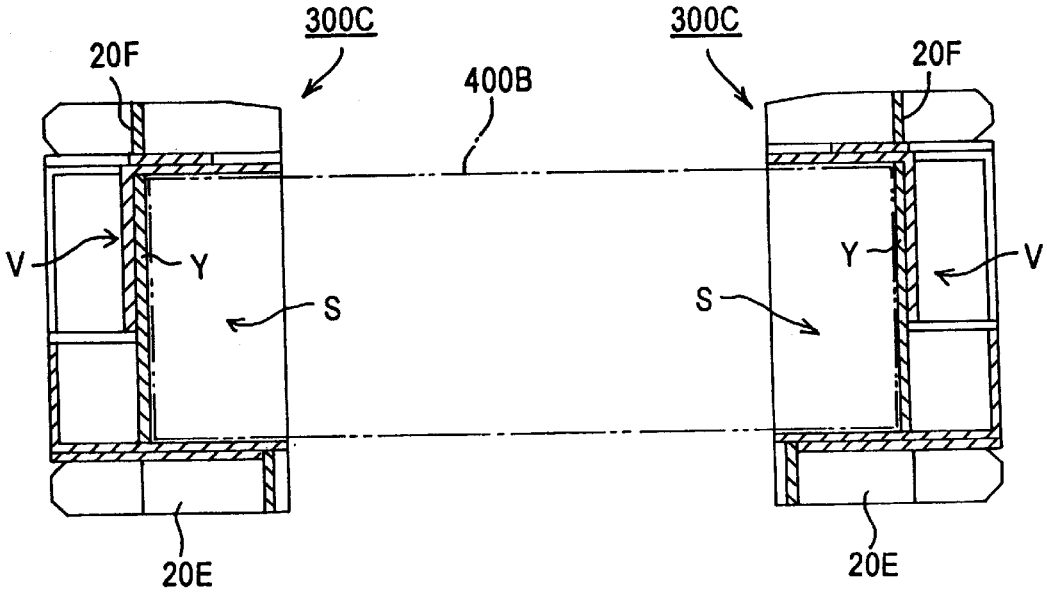
FIG. 20 shows a product 400B of such a shape that is held by two packings 300C at its opposed end portions or opposed side portions.

The inner space S of the packing 300C can receive one end portion or one side portion of a product 400B of a simple rectangular shape (FIG. 20). And, as illustrated in FIG. 20, two packings 300C, 300C can be used to hold opposed end portions or opposed side portions of a product of such a shape, provided that the opposed end portions or opposed side portions of such a product have identical shapes.

Figure 21:
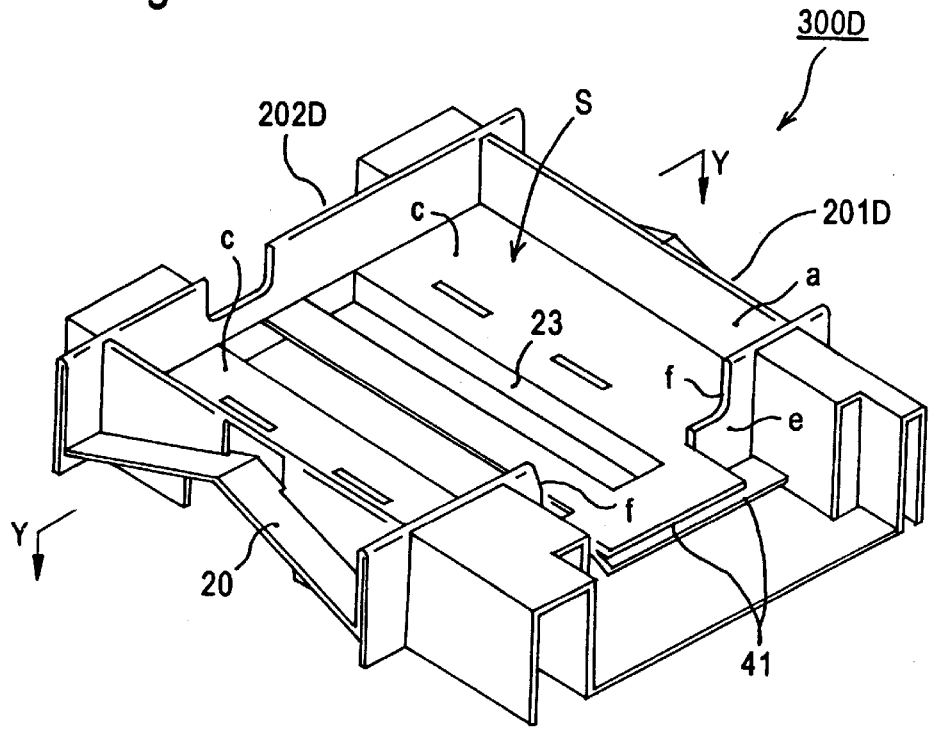
FIG. 21 shows another packing 300D assembled according to the invention.
Figure 22:
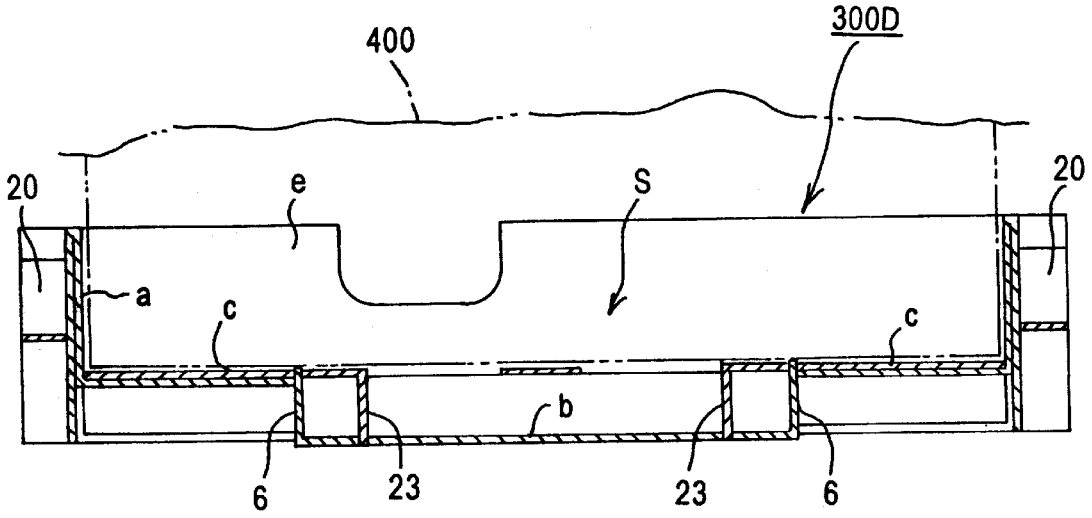
FIG. 22 is a vertical cross section of the packing 300D taken on line Y—Y of FIG. 21.

FIG. 21 illustrates another packing 300D according to the invention. This packing 300D is assembled by mounting a second packing element 202D in a first packing element 201D. This packing 300D is characterized in that the second packing element 202D has two downwardly projecting portions 23, 23 for increased shock absorbing effect. Also, one end wall e of the second packing element 202D has a central opening f, f through which upper and lower bottom pieces 41, 41 are projecting outwardly. These bottom pieces protect accessories for a product supported by the packing 300D that are contained in the packing 300D, against shock. This packing 300D is particularly useful for holding the top or bottom of a product with the shape of a cube, such as a mircowave oven. Thus two packings 300D, 300D can be used to hold the top and bottom of such a product for shipment.

What is claimed is:

1. A packing holding the top or bottom of a product with the shape of a cube, the packing assembled by mounting a second packing element (202D) in a first packing element (201D), said packing being characterized in that the second packing element (202D) has two downwardly projecting portions (23, 23) for increased shock absorbing effect as well as in that one end wall of the second packing element (202D) has a central opening (f, f) through which upper and lower bottom pieces (41, 41) are projecting outwardly to protect accessories the cube-shaped product supported by the packing that are contained in the packing, against shock.

2. A set of sheets of corrugated paper for producing packings (300A, 300B), for holding a rectangular shaped electronic product (400) that is particularly sensitive to shock, said set of sheets comprising:

I) a first flat sheet (101A) of corrugated paper foldable into a first packing element (201A), which includes:

(a) first and second transversely extending parallel central creases (A1, A2), (b) a first central bottom section (b) defined generally by the first and second central creases (A1, A2), said first central bottom section (b) having a first transversely-extending slit (8), (c) a first inner side wall member (1T) adjacent the first bottom section (b) and divided from the first bottom section (b) by the first central crease (A1), (d) a support wall member (6) located between the first bottom section (b) and the first inner side wall member (1T) and at least partially surrounded by the first bottom section (b), a greater part of the support wall member (6) being defined by both a first transversely-extending crease (E) and two right-angled openings (7 7), the support wall member (6) having two projecting portions (6*a*, 6*a*), e) a support surface member (4) surrounded by and located between the first inner side wall member (1T) and the support wall member (6), the support surface member (4) being divided from the support wall member (6) by a second transversely-extending crease (C) and by two parallel longitudinally-extending cuts (5 ), and being divided from the first inner side wall member (1T) by a third transversely-extending crease (D) parallel to the second crease (C) and by the two parallel cuts (5, 5), the two projecting portions (6*a*, 6*a*) of the support wall member (6) being located with part of the support surface member (4) therebetween, (f) a first outer side wall member (1S) located adjacent to and on the outside of the first inner side wall member (1T) and separated therefrom by a first transversely-extending double crease (B1), (g) two longitudinally-extending slits (3, 3) surrounded by the first outer and inner side wall members (1S, 1T), the two slits (3, 3) extending across the first double crease (B), each of the two slits (3, 3) being located near one side of the first sheet (101A), (h) two openings (9, 9) located inside the two slits (3, 3) for receiving projecting portions of the product (400), the two openings (9, 9) starting from an outer line of the first double crease (B1) and extending for the most part into the first inner side wall member (1T), (i) a supporting piece (10) provided between the first inner side wall member (1T) and the first outer side wall member (1S), the supporting piece (10) starting from an inner line of the first double crease (B1) and being mostly surrounded by the first outer side wall member (1S), the supporting piece (10) having three sides defined by a narrow cut (11) and one side defined by a fourth transversely-extending crease (F), (j) a second inner side wall member (2T) corresponding to the first inner side wall member (1T) and located adjacent to the first bottom section (b) on an opposed side of the first inner side wall member (1T), the second inner side wall member (2T) being divided from the first bottom section (b) by the second central crease (A2), (k) a second outer side wall member (2S) corresponding to the first outer side wall member (1S), the second outer side wall member (2S) being located adjacent to and on the outside of the second inner side wall member (2T) and separated therefrom by a second transversely-extending double crease (B2), (1) first and second cushion members (13A, 13B) located between the first bottom section (b) and the second outer side wall member (2S), the second cushion member (13B) separating the second inner side wall member (2T) into two halves, the first and second cushion members (13A, 13B) being separated from each other by one half of the second inner side wall member (2T), each of the first and second cushion members (13A, 13B) being divided from the first bottom section (b)

by a fifth transversely-extending crease (G1) and divided from the second outer side wall member (2S) by one crease and double crease B2, each of the first and second cushion members (13A, 13B) also having another transversely-extending crease (G2) therein, the first cushion member (13A) being separated from said one half of the second inner side wall member (2T) by a longitudinally-extending slit (14), the second cushion member (13B) having two parallel sides defined by two parallel longitudinally-extending cuts (44), each of the first and second cushion members (13A, 13B) having a portion (13*a*) that is defined partly by said another transversely-extending crease (G2) and arranged to be positioned in a horizontal plane when the first sheet (101A) is folded into the first packing element (201A), both the second central crease (A2) and the second double crease (B2) being interrupted by the second cushion member (13B), (m) a first longitudinally-extending end member (16A) provided between the first bottom section (b) and one end of the second outer side wall member (2S), the first end member (16A) being located adjacent to one end of the first bottom section (b) and to one end of the second inner side wall member (2T), the first end member (16A) being divided from the first bottom section (b) by both a sixth transversely-extending crease (H1) and a first longitudinally-extending long slit (15A), said first longitudinally-extending long slit (15A) having a portion (43) extending into the second outer side wall member (2S) which is larger than a remaining portion thereof dividing said first end member (16A) from said first bottom section (b), the first end member (16A) also being divided from the second inner side wall member (2T) by the first long slit (15A) and divided from the second outer side wall member (2S) by a seventh transversely-extending crease (42), the first end member (16A) having therein said sixth transversely extending crease (H1) and an eighth transversely extending crease (H2) parallel to said sixth crease (H1), and (n) a second longitudinally-extending end member (16B) provided between the first bottom section (b) and the second outer side wall member (2S), the second end member (16B) being located adjacent both to an opposed end of the first bottom section (b) and to the first cushion member (13A), the second end member (16B) being divided from the first bottom section (b) both by an extension of said sixth transversely extending crease (H1) and by a second longitudinally-extending long slit (15B) that extends into the second outer side wall member (2S), the second end member (16B) also being divided from the first cushion member (13A) by the second long slit (15B) and divided from the second outer side wall member (2S) by a ninth transversely-extending crease (41), the second end member (16B) having therein an extension of said eighth transversely-extending crease (H2) which partly divides the second end member (16B,) from the first bottom section (b), II) a second flat sheet (102A) of corrugated paper foldable into a second packing element (202A) that can be mounted in the first packing element (201A) to produce a first packing (300A), said second flat sheet (102A) including (a) first and second parallel transversely-extending additional central creases (A, A), (b) a central, second bottom section (c) defined by the first and second additional central creases (A, A), a first longitudinally-extending additional elongated slit (19A), and a first longitudinally-extending crease (J), the second bottom section (c) having plural longitudinally-extending additional slits (21) that are aligned with each other for receiving the respective projecting portions (6*a*, 6*a*) of the support wall member (6) of the first sheet (101A), (c) a longitudinally-extending additional support wall member (23) provided on one side of the second bottom section (c) and divided from the second bottom section (c) by the first longitudinally extending crease (J), the additional support wall member (23) having a first projecting portion (23*a*), (d) a first longitudinally-extending elongated side member (20A) located adjacent to the second bottom section (c) but separated therefrom by the first additional elongated slit (19A), the first elongated side member (20A) having a second projecting portion (20*a*), (e) a second longitudinally-extending elongated side member (20B) located adjacent to the additional support wall member (23) but separated therefrom by a second longitudinally-extending additional elongated slit (19B), the first and second additional central creases (A, A) being interrupted by the second additional elongated slit (19B), (f) two transversely-extending short slits (24, 24) formed continuously with the second additional elongated slit (19B) and that partly define the additional support wall member (23), (g) a first inner end wall member (3T) located adjacent to the second bottom section (c) and the first and second longitudinally extending elongated side members (20A, 20B), the first inner end wall member (3T) being divided from the second bottom section (c) and second longitudinally extending elongated side member (20B) by the first additional central crease (A) and divided from the first longitudinally extending elongated side member (20A) by a tenth transversely-extending crease (45) that is located somewhat more outwards than the first additional central crease (A), the first inner end wall member (3T) also being separated from the additional support wall member (23) by a first one of the short slits (24, 24), each of the first and second additional elongated slits (19A, 19B) extending into the first inner end wall member (3T) at one end thereof, and (h) a first outer end wall member (3S) provided adjacent to and on the outside of the first inner end wall member (3T), the first outer end wall member (3S) being divided from the first inner end wall member (3T) by a second longitudinally-extending crease (B), the first outer end wall member (3S) having two longitudinally-extending third slits (19, 19), one of the two third slits (19, 19) being in alignment with the first additional elongated slit (19A) and the other of the two third slits (19, 19) being in alignment with the second additional elongated slit (19B), (i) a second inner end wall member (4T) opposed to the first inner end wall member (3T), the second inner end wall member (4T) being positioned adjacent to the first and second elongated side members (20A, 20B) as well as the second bottom section (c), the second inner end wall member (4T) being divided from the second bottom section (c) and the second elongated side member (20B) by the second additional central crease (A) and divided from the first side member (20A) by a transversely-extending crease (46) that is located somewhat more outwards than the second additional central crease (A), the second inner end wall member (4T) also being separated from the additional support wall member (23) by a second one of the two short slits (24, 24), each of the additional elongated slits (19A, 19B) extending into the second inner end wall member (4T) at one end thereof, and a second outer end wall member (4S) corresponding to the first outer end wall member (3S), the second outer end wall member (4S) being located adjacent to and on the outside of the second inner end wall member (4T), the second outer end wall member (4S) being divided from the second inner end wall member (4T) by a further longitudinally-extending crease corresponding to said second longitudinally-extending crease (B), the second outer end wall member (4S) having two farther longitudinally-extending slits corresponding to said longitudinally extending third slits (19, 19), one of the two further slits being aligned with the first additional elongated slit (19A) and the other of the two further slits being aligned with the second additional elongated slit (19B), III) a third flat sheet (101B) of corrugated paper foldable into a third packing element (201B), which includes:

(a) a central, third bottom section (N) defined at one side thereof by an eleventh transversely-extending crease (A3), the third bottom section (N) having a second transversely-extending slit (8A), the third bottom section (N) also having a third projecting portion (27) that is partly defined by two further longitudinally-extending cuts (52), (b) a third inner side wall member (3T') located adjacent to and on the outside of the third bottom section (N), the third inner side wall member (3T') being divided from the third bottom section (N) by the eleventh transversely-extending crease (A3), (c) a third outer side wall member (3S') located adjacent to and on the outside of the third inner side wall member (3T') and divided from the same third inner side wall member (3T') by a third transversely-extending double crease (B3), (d) a pair of longitudinally-extending fourth slits (53, 53) intersecting the third double crease (B3), (e) a further opening (49) starting from an outer line of the third double crease (B3) and mostly extending into the third inner side wall member (3T'), (f) a fourth outer side wall member (4S') opposed to the third outer side wall member (3S'), (g) a support piece member (25) embraced by the fourth outer side wall member (4S') and defined by an L-shaped cut (26) and a third longitudinally-extending crease (K), the support piece member (25) also having a fourth longitudinally-extending crease (K), (h) first and second end members (16C, 16D) opposed to each other, the first and second end members (16C, 16D) being located between the fourth outer side wall member (4S') and the central, third bottom section (N), said first and second end members (16C, 16D) being divided from the fourth outer side wall member (4S') by twelfth and thirteenth transversely-extending creases (55, 54), respectively, and from the central third bottom section (N) by a fourteenth transversely-extending crease (H3), each of said first and second end members (16C, 16D) having a fifteenth transversely-extending crease (H4) therein, each of said first and second end members (16C, 16D) being defined partly by a respective one of a pair of longitudinally-extending fifth slits (15C, 15D), each of said fifth slits (15C, 15D) having a larger portion (63), (i) a fourth inner side wall member (4T') located inside the fourth outer side wall member (4S'), the fourth inner side wall member (4T') being generally divided from the fourth outer side wall member (4S') by a fourth double crease (B4) and mostly defined by the fourth double crease (B4), one of the pair of fifth slits (15C), a sixteenth transversely-extending crease (D), and a longitudinally-extending sixth slit (58), (j) a fourth projecting piece (10A) located adjacent to the fourth inner side wall member (4T') and extending into the fourth inner side wall member (4T'), the fourth projecting piece (10A) having plural sides defined by one continuously-extending cut (11A) and also having one side defined by a transversely-extending crease (12A), (k) a second support surface member (V) located inside the fourth inner side wall member (4T') and divided from the fourth inner side wall member (4T') by a transversely-extending crease corresponding to the sixteenth transversely-extending crease (D), the second support surface member (V) being defined by the sixteenth crease (D), one of the fifth slits (15C), an eighteenth transversely-extending crease (C), and longitudinally-extending sixth slit (58), (l) a fourth support wall member (66) located between the second support surface member (V) and the central, third bottom section (N), the fourth support wall member (66) being defined by the eighteenth crease (C), the fifth slit (15C), a nineteenth transversely-extending crease (E), further longitudinally-extending cuts (52), a third transversely-extending slit (28) and longitudinally-extending sixth slit (58), the third slit (28) being located between the fourth support wall member (66) and the third projecting portion (27) of the central, third bottom section (N), (m) a first longitudinally-extending cushion member (21A) divided from the fourth inner side wall member (4T'), second support surface member (V) and fourth support wall member (66) by the sixth slit (58), the first cushion member (21A) being defined by the sixth slit (58), twentieth and twenty-first transversely-extending creases (F3, F4), and a seventh longitudinally-extending slit (57), (n) a second longitudinally-extending cushion member (21B) located adjacent to the first cushion member (21A) but staggered with the first cushion member (21A), the second cushion member (21B) being divided from the first cushion member (21A) by the seventh longitudinally extending slit (57) and defined by the seventh slit (57), twenty-second and twenty-third transversely-extending creases (F1, F2), and an eighth longitudinally-extending slit (56), (o) a top member (T) located between the first and second cushion member (21A, 21B) and the second outer side wall member (4S'), the top member (T) being divided from the first and second cushion members (21A and 21B) by the twenty-third and twenty-first transversely-extending creases (F2 and F4) and from the fourth outer side wall member (4S') by an outer line of the fourth double crease (B4), the fourth double crease (B4) being interrupted by the top member (T) and fourth projecting piece (10A), and (p) a fifth inner side wall member (5T) surrounded by the top member (T), second cushion member (21B), central, third bottom section (N), second end member (16D), and fourth outer side wall member (4S'), the fifth inner side wall member (5T) being defined by the eighth slit (56), a crease (A4), fifth slit (15D), and fourth double crease (B4), IV) a fourth flat sheet (102B) of corrugated paper foldable into a fourth packing element (202B) that in turn can be mounted in the third packing element (201B) to assemble a second packing (300B), said fourth flat sheet (102B) including:

(a) a central, longitudinally-extending fourth bottom section (M) defined by a fifth longitudinally-extending crease (J), twenty fourth and twenty fifth transversely-extending creases (A5, A6), a ninth longitudinally-extending slit (44), and an additional opening (68) that is formed continuously with the ninth slit (44) and has a similar shape to the top member (T) of the third flat sheet (101B), (b) a longitudinally-extending fifth support wall member (53) extending parallel with the fourth bottom section (M) and divided from the fourth bottom section (M) by the fifth crease (J), the fifth support wall member (53) having a fifth projecting portion (53*a*), the fifth support wall member (53) being defined by the fifth crease (J), two opposed L-shaped openings (24', 24'), and a fifth longitudinally-extending cut (39), each of the twenty-fourth and twenty-fifth creases (A5, A6) being interrupted by one of the two opposed L-shaped openings (24', 24'), (c) third and fourth longitudinally-extending side members (20C, 20D) located with the fourth bottom section (M) and fifth support wall member (53) therebetween, the third side member (20C) having a second crease (I), the third side member (20C) also having a sixth projecting portion (20*c*) that is associated with the second crease (I), the third side member (20C) extending adjacent to the fourth bottom section (M) but separated therefrom by the ninth slit (44) and the additional opening (68), the third side member (20C) being defined by the ninth slit (44), the additional opening (68), and twenty-sixth and twenty-seventh transversely-extending creases (47 and 48), the fourth side member (20D) extending adjacent to the fifth support wall member (53) but divided therefrom by the fifth cut (39), (d) a sixth inner end wall member (6T) provided on one side of the fourth bottom section (M), the sixth inner end wall member (6T) being located adjacent to the fourth bottom section (M) and fourth side member (20D) and divided from the fourth bottom section (M) and fourth side member (20D) by the twenty-fourth crease (A5), the sixth inner end wall member (6T) also being located contiguous to the third side member (20C) but divided therefrom by the twenty-sixth crease (47), the twenty-sixth crease (47) being located somewhat more outwards than the twenty-fourth crease (A5), both the ninth slit (44) and one of the two L-shaped openings (24', 24') extending into the sixth inner end wall member (6T), (e) a third outer end wall member (5S) located outside of the sixth inner end wall member (6T) and divided therefrom by a twenty-eighth transversely-extending crease (B5), the third outer end wall member (5S) having a first pair of slits (59), (f) a seventh inner end wall member (7T) provided on an opposed side of the sixth inner end wall member (6T), the seventh inner end wall member (7T) being located adjacent to the fourth bottom section (M) and fourth side member (20D) and divided from the fourth bottom section (M) and fourth side member (20D) by the twenty-sixth crease (A6), the seventh inner end wall member (7T) also being contiguous to the third side member (20C) but divided therefrom by the twenty-seventh crease (48), the twenty-seventh crease (48) being located somewhat more outwards than the twenty-fifth crease (A6), both the ninth slit (44) and one of the two L-shaped openings (24', 24') extending into the seventh inner end wall member (7T), and (g) a fourth outer end wall member (6S) located outside of the seventh inner end wall member (7T) and divided therefrom by a twenty-ninth transversely-extending crease (6B), the fourth outer end wall member (6S) having a second pair of slits (59, 59), one of the slits of the first and second pair of slits (59) of each said outer end wall member (6S, 5S) being aligned with the ninth slit (44), and the other slit of the first and second pair of slits (59, 59) of each said outer end wall member (6S, 5S) being aligned with one portion of the short slits (24', 24').

3. A set of sheets of corrugated paper in accordance with claim 2, wherein a) the first flat sheet (101A) has a recess (12) in its first outer side wall member (1S), b) the second outer side wall member (2S) of the first flat sheet (101A) has a seventh projecting portion (18) which projects toward the first cushion member (13A) and which is defined by two short longitudinally-extending slits (51) and a fourth transversely-extending slit (17), c) the second flat sheet (102A) further has another opening (22) in the second bottom section (c), said another opening (22) sized to permit a user to insert a finger to hold the first packing element (201A), and d) the fourth outer side wall member (4S') of the third flat sheet (101B) has an eighth projecting portion (29) that projects into the fourth inner side wall member (4T') and that is defined by a pair of cuts (64, 65) and a fifth transversely-extending slit (30).

* * * * *